US006255576B1

(12) United States Patent
Suzuki et al.

(10) Patent No.: US 6,255,576 B1
(45) Date of Patent: Jul. 3, 2001

(54) DEVICE AND METHOD FOR FORMING WAVEFORM BASED ON A COMBINATION OF UNIT WAVEFORMS INCLUDING LOOP WAVEFORM SEGMENTS

(75) Inventors: Hideo Suzuki; Masao Sakama; Motoichi Tamura, all of Hamamatsu (JP)

(73) Assignee: Yamaha Corporation, Hamamatsu (JP)

( * ) Notice: Subject to any disclaimer, the term of this patent is extended or adjusted under 35 U.S.C. 154(b) by 0 days.

(21) Appl. No.: 09/365,987

(22) Filed: Aug. 3, 1999

(30) Foreign Application Priority Data

Aug. 7, 1998 (JP) ..... 10-224850

(51) Int. Cl.[7] ..... G10H 1/057; G10H 1/08; G10H 7/00

(52) U.S. Cl. ..... 84/604; 84/625; 84/627

(58) Field of Search ..... 84/604–607, 627, 84/DIG. 9, DIG. 10

(56) References Cited

U.S. PATENT DOCUMENTS 5,069,105 * 12/1991 Iba et al. ..... 84/605
5,123,322 * 6/1992 Hanzawa et al. ..... 84/605
5,225,619 * 7/1993 Sharp ..... 84/604
5,430,241 * 7/1995 Furuhashi et al. ..... 84/604 X
5,637,821 * 6/1997 Izumisawa et al. ..... 84/604
5,808,220 * 9/1998 Yang ..... 84/604 X
5,973,255 * 10/1999 Tanji ..... 84/604 X

FOREIGN PATENT DOCUMENTS 62-14697 1/1987 (JP) .

* cited by examiner

*Primary Examiner*—Stanley J. Witkowski
(74) *Attorney, Agent, or Firm*—Morrison & Foerster

(57) ABSTRACT

Sets of waveform data of unit waveforms stored in a memory each include first and second loop waveform segments at both ends of a non-loop waveform segment and any one of the unit waveform data sets can be selectively readout from the memory. The waveform data set of a desired one of the unit waveforms is read out from the memory and is connected with another waveform preceding or following the read-out unit waveform using the first or second loop waveform segment in the read-out unit waveform. Thus, a smooth connection between the read-out unit waveform and the other waveform is achieved with ease. This is because the loop waveform can be smoothly connected with any other waveform through cross-fade synthesis or phase-matched connection technique performed at an appropriate point in the loop. With such arrangements, when a tone waveform is to be formed by reading out the loop waveform from the memory, it is possible to execute good-quality waveform formation rich in controllability and editability, taking articulation (style of rendition) of a sound into account, in a manner rich in controllability and editability.

16 Claims, 8 Drawing Sheets

DEVICE AND METHOD FOR FORMING WAVEFORM BASED ON A COMBINATION OF UNIT WAVEFORMS INCLUDING LOOP WAVEFORM SEGMENTS

BACKGROUND OF THE INVENTION

The present invention relates generally to devices and methods for forming a waveform of a musical tone, voice or other sound on the basis of waveform data read out from a memory, and more particularly to a waveform generating device and method using loop waveforms read out repeatedly. It will be appreciated that the basic principles of the present invention can be applied extensively to every type of equipment, apparatus and methods having the function of generating musical tones, voices or any other sounds, such as automatic musical performance devices, computers, electronic game devices and multimedia-related devices, not to mention electronic musical instruments. Also, let it be assumed that the terms "tone waveform" in this specification are not necessarily limited to a waveform of a musical tone alone but are used in a much broader sense that embraces a waveform of a voice or any other type of sound.

The so-called "waveform memory readout" technique has already been well known, which prestores waveform data (i.e., waveform sample data) coded by a given coding scheme, such as the PCM (Pulse Code Modulation), DPCM (Differential Pulse Code Modulation) or ADPCM (Adaptive Differential Pulse Code Modulation), and then reads out the thus-prestored waveform data at a rate corresponding to a desired tone pitch to thereby form a tone waveform. So far, various types of "waveform memory readout" technique have been proposed and known in the art, most of which are directed to forming a waveform covering from the start to end of a tone. As one specific example of the waveform memory readout" technique, there has been known prestoring waveform data of a complete waveform of a tone covering from the start to end thereof. As another example, there has been known an approach of prestoring waveform data of a complete waveform for an attach portion of a tone presenting relatively complex variations and prestoring a predetermined loop waveform for a sustain portion of a tone presenting not many variations (e.g., Japanese Patent Laid-open Publication No. SHO-59-188697). In the latter approach, the arrangement of storing the loop waveform for the sustain portion can significantly reduce the necessary quantity of the waveform data to be stored, and also the arrangement of repeatedly reading out the stored loop waveform can effectively adjust the sustained time of the tone as desired. In this specification, the terms "loop waveform" are used to refer to a waveform to be read out repeatedly, i.e., in a looped fashion, and the terms "loop-reproduced waveform" are used to refer to a waveform obtained (reproduced) by reading out the loop waveform repeatedly or in a looped fashion.

Also known in the art is a technique using a plurality of loop waveforms to generate a single tone, where the loop waveforms are read out one after another in given sequence and the resultant loop-read-out data of the successive loop waveforms (i.e., loop-reproduced waveforms) are then subjected to cross-fade synthesis for a smooth connection between the individual loop-reproduced waveforms (e.g., Japanese Patent Laid-open Publication No. SHO-62-14696). In this case, the cross-fade synthesis is effected in predetermined cross-fading sections; however, unlike the above-discussed technique of repeatedly reading out just a single simple loop waveform, this technique is not arranged to variably adjust the time lengths of the individual cross-fading sections. Further, in this case, the loop waveforms are used only in the given sequence corresponding to a single tone.

Among various known examples of the technique of compressing the time axis of a sound signal is one disclosed, for example, in Japanese Patent Laid-open Publication No. HEI-1-93795. This laid-open publication discloses that a sound waveform is divided into a "vowel" section and a "consonant" section and a relatively small time-axial compression ratio is set for the consonant section while a relatively great time-axial compression ratio is set for the vowel section. Further, Japanese Patent Laid-open Publication No. HEI-5-274599 discloses that time-axial compression control is performed only for the vowel section with no time-axial compression control performed for the consonant section. But, these known techniques are directed only to data compression of the sound signal; they never take into account articulation (style of rendition) of the sound and have nothing to do with control of the articulation.

However, the conventionally-known tone waveform generating techniques using the loop waveforms are not satisfactory in that they are not suitable for forming tone waveforms rich in expression and are never related to formation of tone waveforms taking "articulation" (style of performance or rendition) of sounds into account, although they can suitably reduce the necessary quantity of waveform data to be stored. In other known techniques of generating a tone waveform using a plurality of cycles of a waveform prestored for non-repeated or non-looped readout (this type of waveform will hereinafter be called a "non-loop" waveform), the prestored plural-cycle waveform itself can be said to be a good-quality tone waveform taking the articulation (style of rendition) of the sound; however, the sound can be reproduced only as indicated by the prestored waveform data, which would unavoidably result in poor controllability and editability.

SUMMARY OF THE INVENTION

It is therefore an object of the present invention to provide a device and method for generating a tone waveform using a loop waveform which achieve good-quality waveform formation taking articulation (style of rendition) of a sound into account.

It is another object of the present invention to provide a waveform generating device and method which are rich in controllability and editability.

According to a first aspect of the present invention, there is provided a waveform generating device which comprises: a storage section storing sets of waveform data of unit waveforms in such a way that any one of the unit waveforms can be selectively readout from the storage section, each of the unit waveforms including a first loop waveform segment to be read out in a repeated fashion, a non-loop waveform segment to be read out in a non-repeated fashion which follows the first loop waveform segment and a second loop waveform segment to be read out in a repeated fashion which follows the non-loop waveform segment; and a waveform formation section for selecting and reading out one of the unit waveforms, and connecting, via, the first or second loop waveform segment, the read-out unit waveform with another waveform preceding or following the read-out unit, to thereby form a waveform of at least part of a sound.

The present invention is characterized primarily in that sets of waveform data of unit waveforms stored in the storage section each include first and second loop waveform segments at both ends of a non-loop waveform segment and any one of the stored unit waveforms can be selectively readout from the storage section. The waveform formation section selects and reads out the waveform data of a specific one of the unit waveforms, and connects the read-out unit waveform with another waveform preceding or following the read-out unit waveform using the first or second loop waveform segment in the read-out unit, to thereby form a waveform through a sequential combination of the unit waveforms. The non-loop waveform is a high-quality waveform having characteristics of articulation (style of rendition) and the like, and thus is not, by itself, suitable for achieving a smooth connection with another waveform. Therefore, in the past, it was not possible to readily connect such a high-quality non-loop waveform, having characteristics of articulation (style of rendition) and the like, with another waveform, to thereby achieve free waveform formation. By contrast, the present invention, which is characterized in that each of the unit waveforms stored in the storage section includes first and second loop waveform segments at both ends of a non-loop waveform segment and any one of the unit waveforms can be selectively readout from the storage section, permits a smooth connection between the waveform based on the selectively read-out unit waveform and any other waveform. This is because the loop waveform is suitable for achieving a smooth connection with any other waveform through a connecting technique such as cross-fade synthesis or phase-matched connection at an appropriate point in the loop. With such arrangements, the present invention can easily combine a non-loop waveform, which is a high-quality waveform having characteristics of articulation (style of rendition) and the like, with any other waveform, to thereby permit free waveform formation. Thus, the present invention affords the superior benefit that it permits good-quality waveform formation, taking articulation (style of rendition) of a sound into account, in a manner rich in controllability and editability.

According to a second aspect of the present invention, there is provided a waveform generating device which comprises: a storage section storing first unit waveform data including a non-loop waveform segment to be read out in a non-repeated fashion and at least one loop waveform segment to be read out in a repeated fashion which connects to at least one of front and rear ends of the non-loop waveform segment, and second unit waveform data including at least one loop waveform segment to be read out in a repeated fashion, one of the first and second unit waveform data being capable of being selectively read out from the storage section; and a waveform formation section for selecting and reading out the first and second unit waveform data in succession, during which time the waveform formation section repeatedly reads out the loop waveform segments of the first and second unit waveform data in a looping time section and executes cross-fade synthesis between the repeatedly read-out loop waveform segments of the first and second unit waveform data, to thereby form a waveform of at least part of a sound, the waveform formation section controlling a time length of the cross-fade synthesis in accordance with time control information.

The invention according to the second aspect is characterized primarily in that the storage section stores first unit waveform data including a non-loop waveform segment to be read out in a non-repeated fashion and at least one loop waveform segment to be read out in a repeated fashion which connects to at least one of front and rear ends of the non-loop waveform segment, and second unit waveform data including at least one loop waveform segment to be read out in a repeated fashion, and any one of the first and second unit waveform data being capable of being selectively read out from the storage section. Thus, by combining the unit waveform data including the loop waveform and non-loop waveform segments with other unit waveform data including a loop waveform segment via their respective loop waveform segments, the present invention can easily combine a non-loop waveform, which is a high-quality waveform having characteristics of articulation (style of rendition) and the like, with any other waveform, to thereby permit free waveform formation, similarly to the above-mentioned; thus, the present invention affords the superior benefit that it permits good-quality waveform formation, taking articulation (style of rendition) of a sound into account, in a manner rich in controllability and editability. In addition, when cross-fade synthesis is performed between loop-reproduced waveforms based on the two waveforms in their respective connecting sections, the present invention allows the time length of the cross-fade synthesis to be freely controlled in accordance with time control information, so that the total time axial length or duration of a tone waveform to be formed can be variably controlled freely and independently of the pitch of the tone waveform. As a consequence, time-axial stretch/compression control can be suitably employed in order to carry out good-quality waveform formation taking articulation (style of rendition) of a sound into account, which can further increase the controllability.

The non-loop waveform is generally fixed in its reproduction time length, and the only way for varying the reproduction time length is to change the reproduction pitch. For this reason, some difficulty would be encountered when the reproduction time length of the non-loop waveform is to be variably controlled without influencing the reproduction pitch. The reproduction time length of the loop waveform, on the other hand, can be variably controlled to be stretched or compressed without influencing the reproduction pitch, by just variably controlling the number of loop readout, and thus the time-axial stretch/compression control of the waveform data can be performed very easily. Thus, taking advantage of the easiness of the time-axial stretch/compression control over loop-reproduced waveforms, the present invention is arranged to execute the time-axial stretch/compression control in cross-fading sections using loop waveforms, to thereby variably stretch or compress the total reproduction time length of an entire tone waveform including a high-quality non-loop waveform segment and a loop waveform segment.

According to a third aspect of the present invention, there is provided a waveform generating device which comprises: a storage section storing waveform data of a tone waveform corresponding to a performance containing a plurality of notes, the tone waveform including a non-loop waveform segment to be read out in a non-repeated fashion and loop waveform segments to be read out in a repeated fashion, the tone waveform including at least one such loop waveform segment for each individual one of the notes; and a waveform readout section for reading out the waveform data of the tone waveform from the storage section, the waveform readout section reading out the waveform data of the non-loop waveform segment only once and reading out the waveform data of each of the loop waveform segments repeatedly, the waveform readout section variably controlling a time length of repeated readout of the loop waveform segment corresponding to a specific one of the notes, to thereby variably control a time length of the specific note.

The invention according to the third aspect is characterized primarily in that the storage section stores waveform data of a tone waveform corresponding to a performance containing a plurality of notes, and the tone waveform includes a non-loop waveform segment to be read out in a non-repeated fashion and loop waveform segments to be read out in a repeated fashion. For such a tone waveform corresponding to a performance containing a plurality of notes, the waveform data of the non-loop waveform segment are read out only once while the waveform data of each of the loop waveform segments are read out repeatedly, and the time length of repeated readout of the loop waveform segment corresponding to a specific one of the notes is variably controlled, to thereby allow the time-axial length or duration of the specific note to be variably controlled to be stretched or compressed in a selective manner. Similarly to the above-mentioned, taking advantage of the easiness of the time-axial stretch/compression control over loop-reproduced waveforms, the present invention is arranged to apply the time-axial stretch/compression control to the loop waveform segment corresponding to the specific note, to thereby variably stretch or compress the total reproduction time length of an entire tone waveform including a high-quality non-loop waveform segment and a loop waveform segment. As a consequence, the present invention greatly facilitates the time-axial stretch/compression control of a high-quality tone waveform corresponding to a performance containing a plurality of notes.

Thus, if a waveform of a phrase performance corresponding to a plurality of notes is constructed using the above-mentioned data structure, the present invention can realize various special control based on the time-axial stretch/compression control. Assume a case where principal portions of first, second and third notes are each formed by a non-loop waveform, portions connecting these notes by a special style of rendition, such as a slur, are also each formed by a non-loop waveform, and portions connecting these non-loop waveforms are each formed by a loop waveform. In this case, the lengths of the individual notes can be stretched or compressed uniformly at a predetermined ratio, by controlling the respective loop reproduction sections of these non-loop waveforms at given time-axial stretch/compression ratios (e.g., an eight note can be changed to a quarter note). Alternatively, an apparent performance tempo can be variably controlled using such an inventive arrangement. Further, by controlling the loop waveform of a specific one of the notes at a time-axial stretch/compression ratio different from those for the other notes, only the length of the specific note can be varied selectively. For example, the present invention can execute control to allow a phrase of an eighth-note triplet to be changed into a phrase of one eighth note and two sixteenth notes.

The present invention may be implemented not only as the device invention as set forth above but also as a method invention. Further, the present invention may be practiced as a computer program and as a recording medium storing such a computer program. Furthermore, the present invention may be embodied as a recording medium storing waveform data in a novel data structure.

BRIEF DESCRIPTION OF THE DRAWINGS

For better understanding of the object and other features of the present invention, its preferred embodiments will be described in greater detail hereinbelow with reference to the accompanying drawings, in which.

DETAILED DESCRIPTION OF THE PREFERRED EMBODIMENTS

Figure 1:
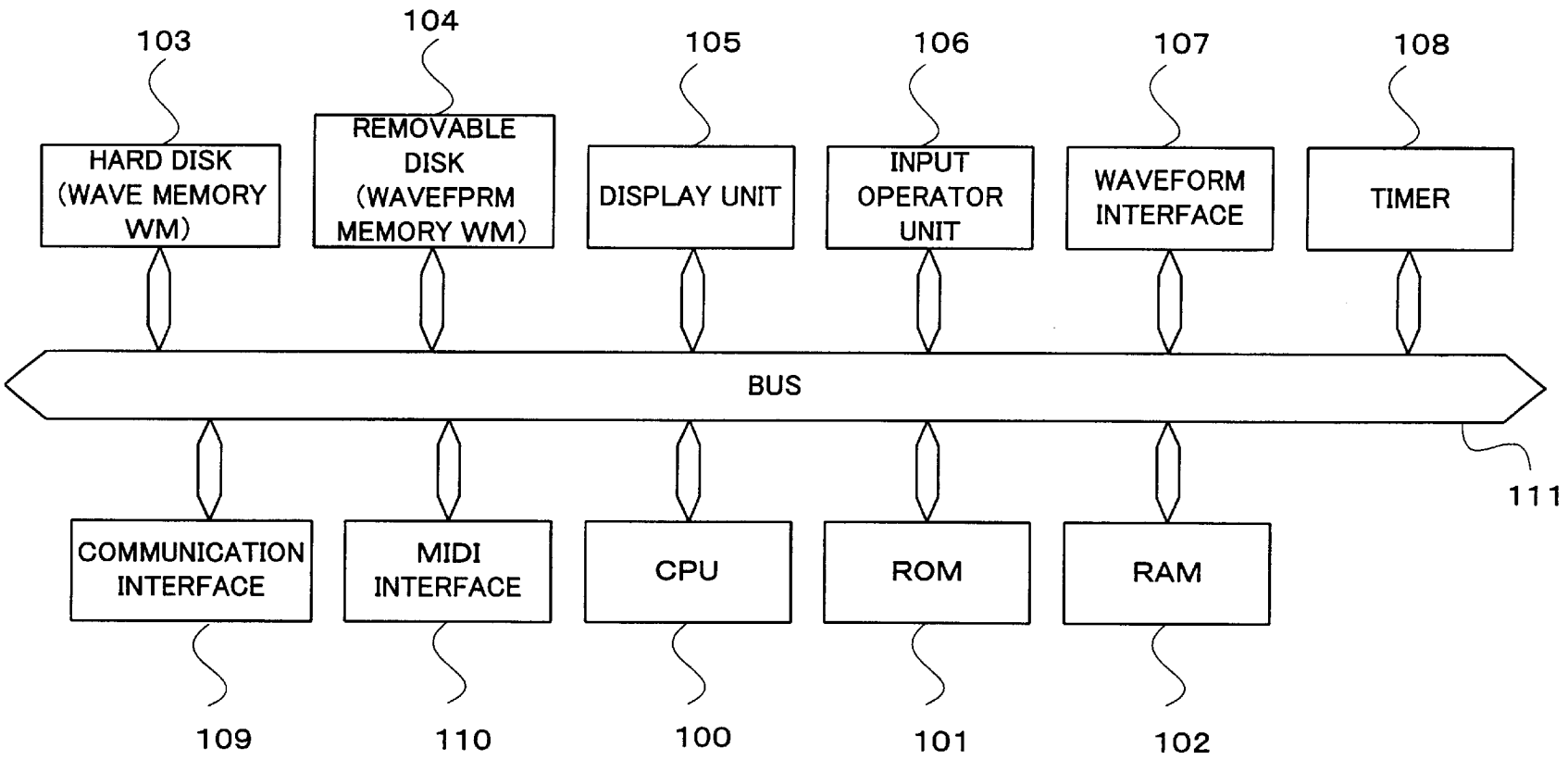
FIG. 1 is a block diagram showing an exemplary hardware organization of a waveform generating device in accordance with a preferred embodiment of the present invention.

FIG. 1 is a block diagram showing an exemplary hardware organization of a waveform generating device in accordance with a preferred embodiment of the present invention. The waveform generating device illustrated in this figure is constructed using a computer, and predetermined waveform formation processing is carried out in the embodiment by the computer executing a predetermined waveform forming program (software). However, it should be apparent that the waveform formation processing may be implemented by microprograms for execution by a DSP (Digital Signal Processor), rather than by such computer software. Also, the waveform formation processing may be implemented by a dedicated hardware device that includes discrete circuits or integrated or large-scale integrated circuit. Further, the waveform generating device of the present invention may be implemented as an electronic musical instrument, karaoke device, electronic game device, multimedia-related device, personal computer or any other form of product.

In FIG. 1, the waveform generating device in accordance with the preferred embodiment of the invention includes a CPU (Central Processing Unit) 100 functioning as a main control section of the computer, to which are connected, via a bus 111, a ROM (Read-Only Memory) 101, a RAM (Random Access Memory) 102, a hard disk device 103, a removable disk device (such as a CD-ROM drive or MO drive) 104, a display unit 105, an input operator unit 106 including a keyboard and a mouse, a waveform interface 107, a timer 108, a communication interface 109, a MIDI interface 110, etc. The waveform interface 107 has a function of receiving an analog waveform signal (audio signal) from outside the waveform generating device, converting the received waveform signal into digital representation and then passing the converted digital signal to the bus 111, and a function of receiving, via the bus 111, digital waveform data generated by the computer executing the waveform generating processing and outputting the digital waveform data to a speaker system (not shown) or the like after converting the waveform data into analog representation. Of course, the digital waveform data generated through the waveform generating processing may be output from the waveform generating device without being converted into analog representation.

In the case where the waveform generating device is embodied as a musical instrument product, then the input operator unit 106 includes a performance keyboard for selectively designating desired tone pitches. On the other hand, in the case where the waveform generating device is embodied as a product other than a musical instrument, a MIDI keyboard module is connected to the MIDI interface 110 so that desired tone pitches can be selectively designated through the MIDI keyboard module. Alternatively, desired tone pitches may be selectively designated via automatic performance data. The automatic performance data may either be supplied from any of the ROM 101, RAM 102, hard disk device 103, removable disk device 104, etc. or be supplied from an external source via the MIDI interface 110. As conventionally known in the field of electronic musical instruments, various switches and other operators for selecting and setting various tonal factors, such as tone colors, effects, volume levels, are provided on the input operator unit 106 as necessary, although not described here in detail. Selection and setting of these tonal factors may be made via the automatic performance data in a similar manner to the tone pitch designation.

Function of a waveform memory WM storing waveform data may be assigned to any type of data storage device. Namely, in the illustrated example, any of the above-mentioned ROM 101, RAM 102, hard disk device 103 and removable disk device 104 may be assigned to perform the function of the waveform memory WM. In general, given storage areas of the hard disk device 103 having a large capacity or a removable recording medium, such as a CD-ROM or MO, removably attachable to the removable disk device 104 may be assigned to function as the waveform memory WM or as a waveform database. Alternatively, the waveform generating device may access a waveform database provided in an external host or server computer via the communication interface 109 and a communication line, so as to download necessary waveform data into the hard disk device 103, RAM 102 or the like.

The above-mentioned software program for executing the waveform formation processing in accordance with the present invention under the control of the CPU 100 may be prestored in any one of the ROM 101, RAM 102 and hard disk device 103. Alternatively, this software program may be stored in a removable recording medium, such as a CD-ROM or MO, removably attachable to the removable disk device 104, or may be received from an external host or server computer via the communication interface 109 and a communication line and downloaded into the hard disk device 103, RAM 102 or the like.

In the above-mentioned waveform memory WM, there are prestored waveform data of a multiplicity of "unit waveforms". Here, the terms "unit waveform" refer to one basic unit of waveform that can be selected independently per designation. The unit waveforms may be classified into a plurality of types, according to both their musical or emotional meaning and their technical meaning based on a particular way in which the waveform data are read out from the memory. More specifically, the classification according to the technical meaning is based on whether or not the waveform data are read out in a repeated or looped fashion; for convenience of description, each unit waveform whose waveform data are read out repeatedly will hereinafter be called a "loop waveform", while each unit waveform whose waveform data are not read out repeatedly will hereinafter be called a "non-loop waveform". The classification according to the musical or emotional meaning, on the other hand, is based on which portion or section of a sound the waveform in question can be suitably used for. For example, each unit waveform which is suitable for use in the rising or attach portion of a sound may be named an "attack portion waveform", each unit waveform which is suitable for use in the falling or release portion of a sound may be named a "release portion waveform", each unit waveform which is suitable for use in the sustain portion of a sound may be named a "sustain portion waveform", each unit waveform which is suitable for use in a connecting portion between sounds based on a particular style of rendition, such as a slur, may be named a "connecting rendition waveform", each unit waveform which is suitable for use in the sustain portion of a sound according to a particular style of rendition, such as a vibrato or tremolo, may be named an "intermediate rendition waveform", and so on.

In a normal music performance, non-standing or unsteady waveforms rarely occur in succession, and even in a portion where a non-loop waveform is required, steady waveforms appear immediately before and after the non-loop waveform. Therefore, in most cases, even a waveform strongly representing unique characteristics of a particular style of rendition can be expressed by such a unit waveform that includes loop waveform segments at both ends of a non-loop waveform segment. In general, it is desirable that a unit waveform, to be suitably used for a portion where delicate articulation (style of rendition) is required, include a "non-loop waveform" segment capable of strongly expressing the unique characteristics of the articulation (style of rendition). Each non-loop waveform is normally composed of a plurality of wave cycles that is necessary and sufficient for expressing the unique characteristics of the articulation (style of rendition) in question. For a relatively monotonous portion of a sound, on the other hand, it is preferable to use a loop waveform with a view to saving the quantity of the waveform data to be stored. Each loop waveform is normally composed of a single or an appropriate plurality of wave cycles. The loop waveform itself can be used as a unit waveform for a relatively monotonous sound portion, e.g., as a "sustain portion waveform". In such a case, a waveform of the sustain portion of a continuing sound may be formed by sequentially combining a plurality of the loop unit waveforms; this approach is very advantageous in that the combination of the loop unit waveforms can significantly improve the quality of the sound. Further, when it is desired to smoothly connect together successive unit waveforms, the "loop waveform" can also be advantageously used in the connecting portion between the unit waveforms. Thus, even with a unit waveform containing a "non-loop waveform" segment, it is preferable that a "loop waveform" segment be previously included at the beginning or end thereof that would become a connecting portion with another unit waveform. Thus, any unit waveform including loop waveform segments at both ends of a non-loop waveform segment can be appropriately connected with another unit waveform via the loop waveform segments immediately before and after the non-loop waveform segment, so that this unit waveform can be suitably used, for example, as a unit waveform of a "connecting rendition waveform" or "intermediate rendition waveform". There may also be used unit waveforms comprising a "non-loop waveform" segment alone, in which case, however, a smooth connection of such a unit waveform with another unit waveform may be difficult to achieve even though an appropriate phase-matching process or the like is applied to the connecting portion.

Note that the above-mentioned "sustain portion waveform", "connecting rendition waveform", "intermediate rendition waveform", etc. will hereinafter be collective called an "intermediate waveform".

FIGS. 2A to 2D are schematic diagrams illustrating typical examples of the unit waveforms stored in the waveform memory WM. Here, for simplicity of illustration, the unit waveforms are shown just schematically, and only the general outlines of the waveforms are shown within a rectangular box. Note that in the illustrated examples, the unit waveforms are each stored with a desired amplitude envelope imparted thereto and without their amplitude peak levels normalized. Of course, the present invention is not so limited; instead, the unit waveforms may each be stored with amplitude peak levels normalized to a predetermined value and a given amplitude envelope may be imparted to the waveform when the waveform is read out from the memory for reproduction. In the figures, the horizontal axis represents the address of the memory. Let's assume here that the waveform data of each of the unit waveforms stored in the memory WM are in pulse code modulated (PCM) form, although the waveform data may be in any other coded form than the PCM, such as the DPCM or ADPCM.

Figure 2A:
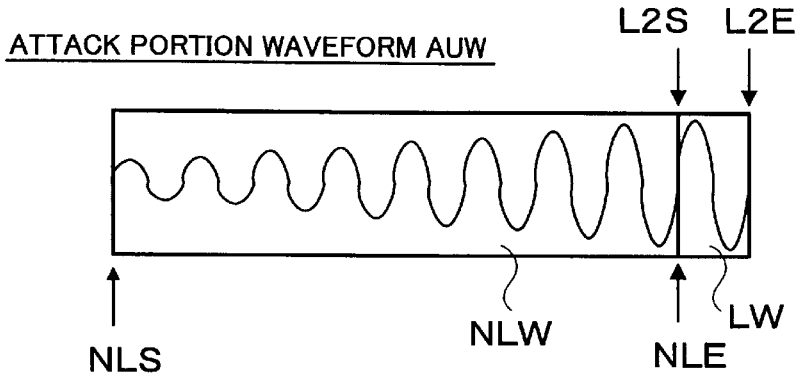
FIGS. 2A to 2D are conceptual diagrams illustrating several specific examples of unit waveforms stored in a waveform memory of FIG. 1.

More specifically, FIG. 2A shows an example of an attack portion waveform AUW, which is composed of a preceding non-loop waveform segment NLW and a succeeding or trailing loop waveform segment LW. The start and end points, In the waveform memory WM, of the non-loop waveform segment NLW of this attack portion waveform AUW are specified by given start and end addresses NLS and NLE, respectively. The start and end points of the loop waveform segment LW are specified by given loop start and end addresses L2S (=NLE) and L2E, respectively.

Figure 2B:
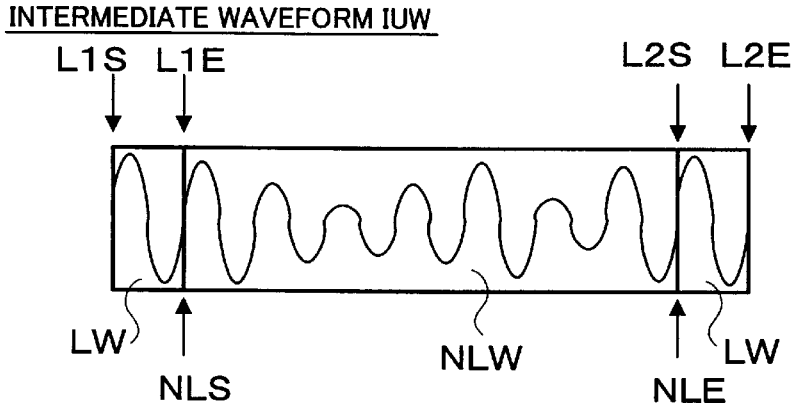

FIG. 2B shows an example of a unit waveform classified as an intermediate waveform IUW such as a sustain portion waveform, and this intermediate waveform IUW is composed of loop waveform segments LW located immediately before and after a predetermined non-loop waveform segment NLW. The start and end points, in the waveform memory WM, of the preceding loop waveform segment LW of this intermediate waveform IUW are specified by given loop start and end addresses L1S and L1E, respectively. The start and end points of the non-loop waveform segment NLW of this intermediate waveform IUW are specified by given start and end addresses NLS (=L1E) and NLE, respectively. Further, the start and end of the succeeding loop waveform segment LW (immediately after the non-loop waveform segment NLW) of this intermediate waveform IUW are specified by given loop start and end addresses L2S (=NLE) and L2E, respectively Note that the unit waveform classified as such an intermediate waveform IUW is not limited to the illustrated example and may include only a single loop waveform segment LW as illustrated in FIG. 2D, in which case the start and end points of the single loop waveform segment LW are specified by given loop start and end addresses L1S and L1E, respectively.

Figure 2C:
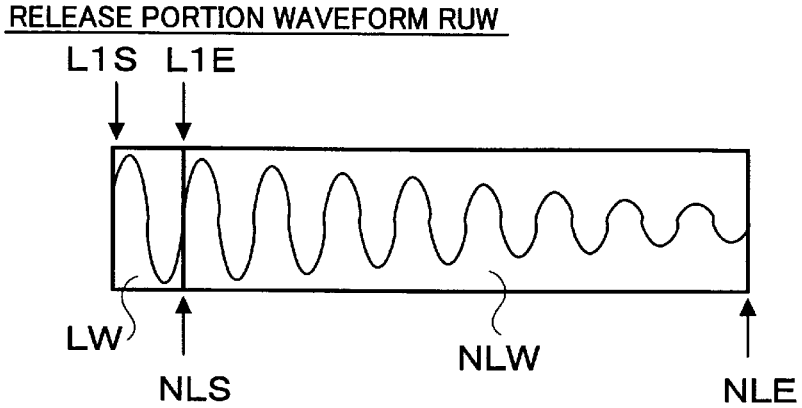
Figure 2D:
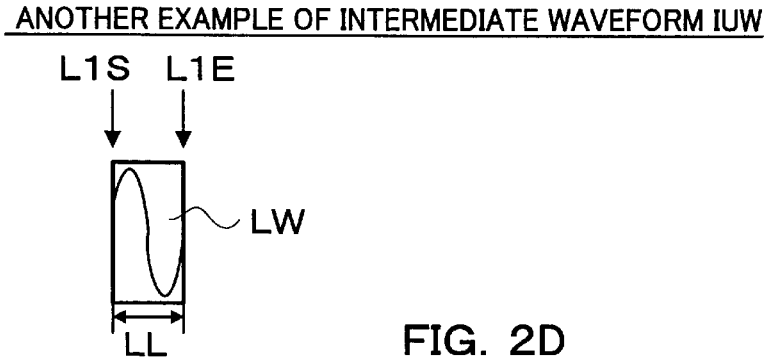

FIG. 2C shows an example of a release portion waveform RUW, which is composed of a leading or preceding loop waveform segment LW and a succeeding non-loop waveform segment NLW. The start and end points, in the waveform memory WM, of the loop waveform segment LW of this release portion waveform RUW are specified by given loop start and end addresses L1S and L1E, respectively. Further, the start and end points of the non-loop waveform segment NLW of this release portion waveform RUW are specified by given start and end addresses NLS (=L1E) and NLE, respectively. As noted above, the attack portion waveform AUW or the release portion waveform RUW may be composed of a non-loop waveform segment NLW alone without any loop waveform segment LW.

As previously mentioned, the loop start address L1S (or L2S) is the address at the start point of the loop waveform LW and represents the start address of repeated or looped readout. The loop end address L1E (or L2E) is the address at the end address of looped readout. Alternatively, the loop end address may be specified by a combination of the loop start address LS and data indicating a length of the loop waveform LW (i.e., loop length LL) in the number of addresses, rather than by directly designating the loop end address. In this case, the repeated or looped readout of the loop waveform LW is carried out by repetitively reading out the waveform data from the loop start address L1S (or L2S) to the loop end address (L1E or L2E+LL").

Just for convenience of the following description, each unit waveform including a combination of loop waveform segment LW and non-loop waveform segment NLW will be called a "composite unit waveform", and each unit waveform consisting only of a loop waveform LW will be called just a "loop waveform".

Figure 3:
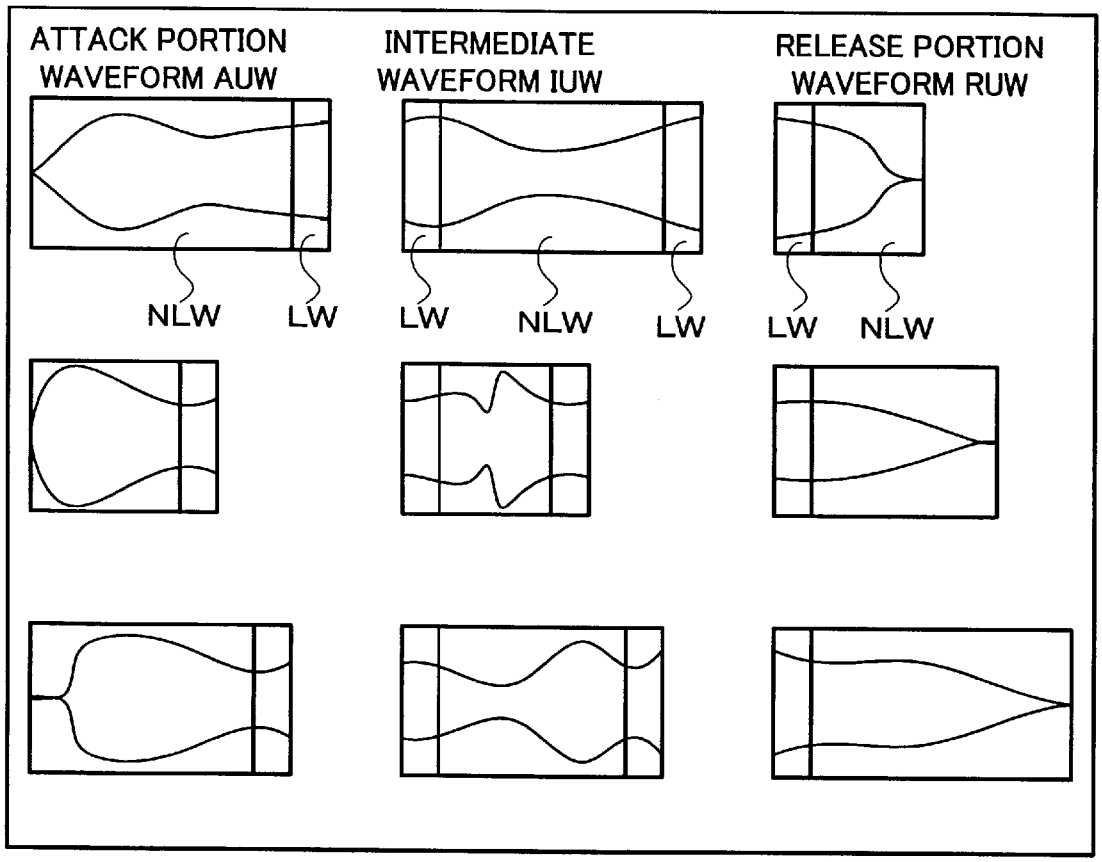
FIG. 3 is a diagram showing exemplary storage formats of composite unit waveforms in the waveform memory.

FIG. 3 is a diagram showing exemplary storage formats of the composite unit waveforms, i.e., the above-described attack portion waveform AUW, intermediate waveform IUW and release portion waveform RUW. In order from the left to the right of FIG. 3, there are shown exemplary stored formats of the attack portion waveform AUW, intermediate waveform IUW and release portion waveform RUW; however, just approximate outlines of these waveforms are illustrated here by their envelopes within rectangular boxes.

In the waveform memory WM, as clearly seen from FIG. 3, there are prestored a multiplicity of sets of waveform data of attack portion waveforms AUW, release portion waveforms RUW and intermediate waveforms IUW including a connecting rendition waveform etc., for a variety of sounds. In this case, there may be prestored different sets of waveform data in association with a plurality of tone colors and other tonal characteristics (such as characteristics corresponding to tone pitches or note ranges and modulation characteristics such as vibrato, slur and the like). Namely, in stead of prestoring only one plural-cycle unit waveform per tone color, a plurality of different unit waveforms corresponding to various tone colors or note ranges, various touch intensity levels (velocities), various styles of rendition (vibrato, tremolo, pitch bend, slur etc.), or various specific manners of executing the rendition (quick slur, slow slue etc.) are prestored for each of the tone colors in the illustrated example. For example, as the attack portion waveforms AUW, waveforms having a "sharp rise", a "slow rise with a glide" etc. are prestored; as the release portion waveforms RUW, waveforms having a "rapid fall with a vibrato" etc. are prestored; and as the intermediate waveforms IUW, waveforms having a tenuto with a small attack portion of a next sound etc. are prestored. It is not always necessary that a different set of waveform data be used for each of the tone colors; instead, a same set of waveform data can be shared between different tone colors. Further, the prestored plural-cycle waveforms may either include same tone volume envelopes as in the original waveforms or have their tone volume envelopes normalized to a predetermined level. Furthermore, the prestored plural-cycle waveforms may either be sampled waveforms supplied from an external source, or be waveforms having been subjected to an appropriate waveform treatment process such as cross-fade synthesis, filter process or the like.

Figure 4A:
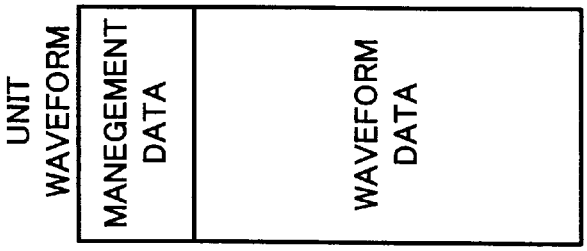
FIGS. 4A to 4E are diagrams showing exemplary storage formats in the waveform memory.

FIG. 4A is a diagram outlining a general storage format in the waveform memory WM, which, as shown, is composed of a management data area and a waveform data area. The waveform data area is provided for individually storing the waveform data (specific waveform sample data) of a multiplicity of the unit waveforms as described above. The management data area is provided for storing various necessary management information for the individual waveform data stored in the waveform data area.

Figure 4B:
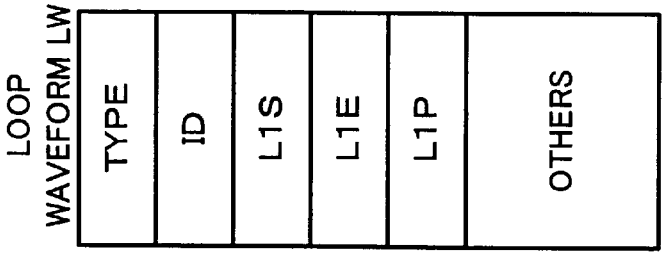
Figure 4C:
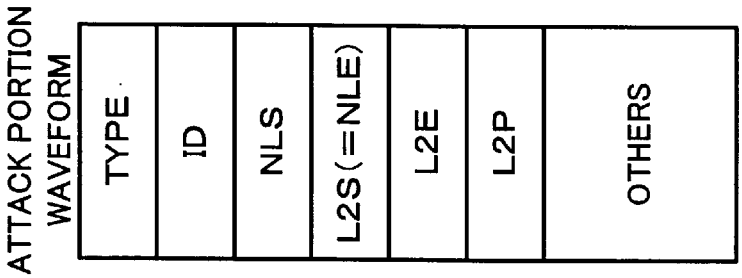
Figure 4D:
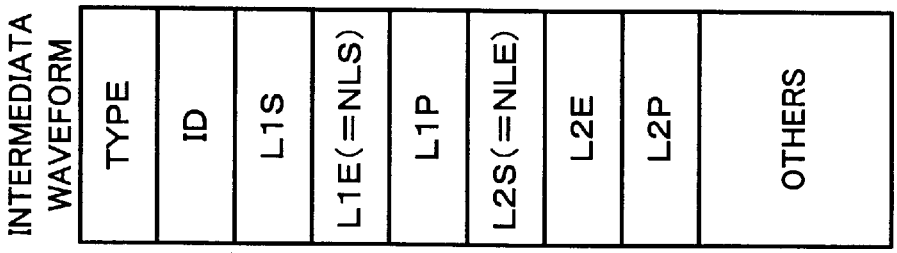
Figure 4E:
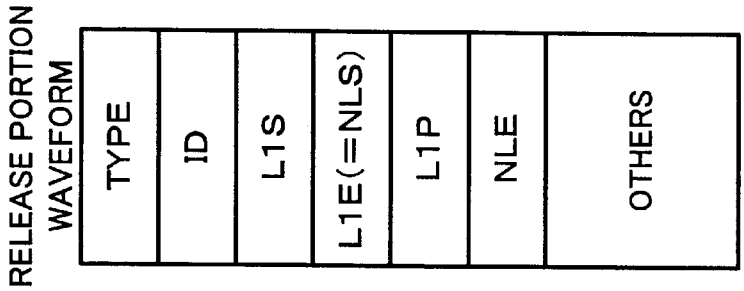

FIGS. 4B to 4E are diagrams showing exemplary storage formats of the management data stored in the management data area of the waveform memory WM, for several types of unit waveforms. More specifically, FIG. 4B shows an example of the management data for an intermediate waveform IUW ("sustain portion waveform") comprising a loop waveform LW alone, FIG. 4C shows an example of the management data for an attack portion waveform AUW including a non-loop waveform segment NLW and a loop waveform segment LW, FIG. 4D shows an example of the management data for an intermediate waveform IUW including a first loop waveform segment LW, a non-loop waveform segment NLW and a second loop waveform segment LW (i.e., "connecting rendition waveform" or "intermediate rendition waveform"), and FIG. 4E shows an example of the management data for a release portion waveform RUW including a first loop waveform segment LW and a non-loop waveform segment NLW. Note that a loop waveform segment preceding a non-loop waveform segment is herein called a first loop waveform segment, and a loop waveform segment following a non-loop waveform segment is herein called a second loop waveform segment. Whereas different formats are used for the attack portion waveform AUW, intermediate waveform IUW and release portion waveform RUW in FIG. 4, all of these waveforms may be stored in the same format of FIG. 4D, in which case, however, the waveforms are distinguished from each other using there respective identification data ID as will be later described.

In the illustrated examples of FIG. 4, type data TYPE is indicative of a particular type of the unit waveform in question. Specifically, the type data TYPE in the example of FIG. 4B indicates that the associated unit waveform is an "intermediate waveform IUW comprising a loop waveform LW alone", the type data TYPE in the example of FIG. 4C indicates that the associated unit waveform is an "attack portion waveform AUW including a non-loop waveform segment NLW and a second loop waveform segment LW", the type data TYPE in the example of FIG. 4D indicates that the associated unit waveform is an "intermediate waveform IUW including a first loop waveform segment LW, a non-loop waveform segment NLW and a second loop waveform segment LW", and the type data TYPE in the example of FIG. 4E indicates that the associated unit waveform is a "release portion waveform RUW including a first loop waveform segment LW and a non-loop waveform segment NLW". The type data TYPE also includes other information capable of indicating the waveform type in any one of several specific manners corresponding to the above-mentioned waveform types. The identification data ID identifies each individual unit or set of waveform data; the identification data ID may, for example, be a file name of the waveform data set.

As noted above, a plurality of different unit waveforms are prestored for each of the attack portion waveform AUW, intermediate waveform IUW and release portion waveform RUW. In the described embodiment, these different unit waveforms for each type of the waveforms AUW, IUW, RUM can be distinguished from each other by attaching unique identification data ID to each of the unit waveforms. The start addresses (L1S, NLS, L2S, etc.) and end addresses (L1E, NLE, L2E, etc.) are the start and end addresses of the loop waveform LW or the non-loop waveform NLW (see FIG. 2). Phase information (L1P, L2P etc.) is indicative of an initial phase at the beginning of the loop waveform LW. Further, "other information" in FIG. 4 includes data indicative of a tone pitch, volume and amplitude. Note that the data formats are not limited to those mentioned above and the phase information may be omitted from some or all of the data formats.

The above-described various types of unit waveforms are managed by a database, so that a user can find any desired unit by searching through the database using, as search keys, one or more of the property, style of rendition and specific manner of executing the rendition, tone pitch, touch intensity, tone volumes, etc.

Figure 5:
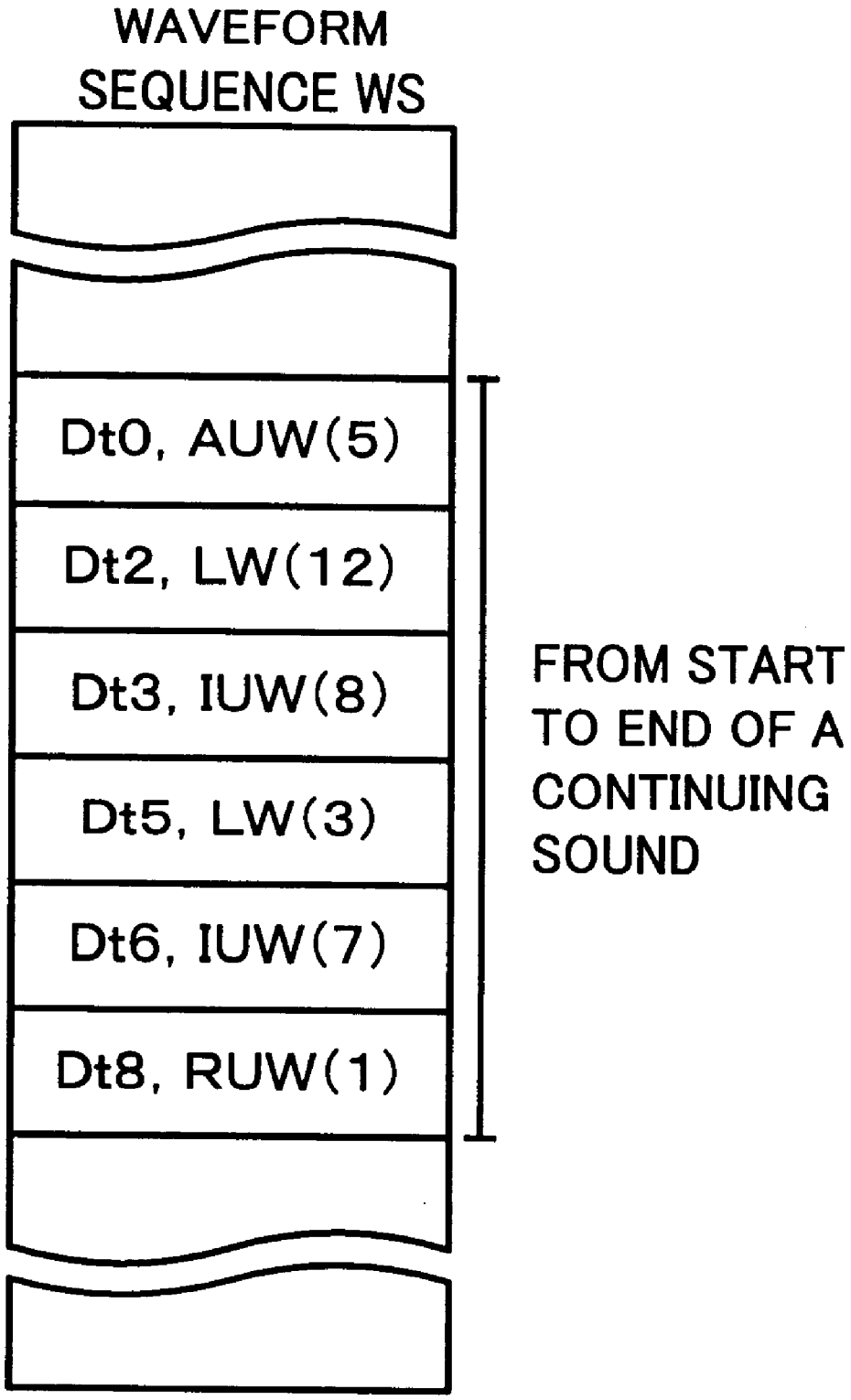
FIG. 5 is a diagram showing an example of sequence data in one waveform sequence.
Figure 6:
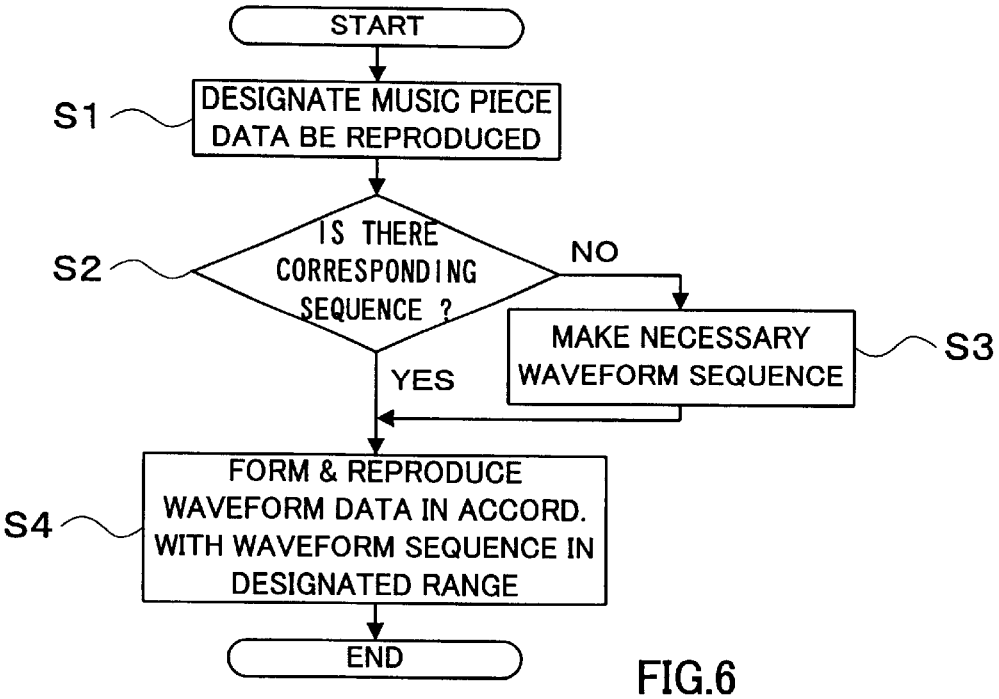
FIG. 6 is a flow chart showing an example of a waveform reproduction process carried out in the embodiment of the present invention.

In the inventive waveform generating device of FIG. 1, the waveform formation is carried out by the computer executing a predetermined program (software) for implementing the waveform formation processing of the present invention. Specifically, a waveform of a continuing sound (e.g., one or more sounds or part of a sound with no break) can be formed by selectively reading out a plurality of the prestored unit waveforms from the waveform memory WM in a predetermined sequence (hereinafter called a "waveform sequence WS") and combining together the waveform data of these read-out unit waveforms. FIG. 5 is a diagram showing an example of sequence data in one waveform sequence WS, which is stored in a waveform sequence memory section provided within an appropriate data storage device such as the RAM 102 and hard disk device 103. FIG. 6 is an exemplary flow chart of the predetermined program (software) for implementing the waveform formation processing of the present invention.

The waveform sequence WS of FIG. 5 is arranged to permit reproduction of a waveform as described later in relation to FIG. 8A.

The waveform sequence WS is composed of a series of waveform events that include data selecting or designating unit waveforms ("AUW(5)", "LW(12)", . . . ) and timing data ("Dt0", "Dt2", . . . ) indicative of particular time points when the unit waveforms are to be reproduced, i.e., when the sounds represented by the unit waveforms should start being audibly generated. The above-mentioned waveform designating data ("AUW(5)", "LW(12)", . . . ) correspond to the identification data ID stored in the management data area shown in FIG. 4, and the timing data ("Dt0", "Dt2", . . . ) correspond to reproduction starting time points of unit waveforms shown in a reproduced waveform diagram of FIG. 8A; namely, the timing data Dt0 corresponds to the reproduction start time tO, the timing data Dt2 corresponds to the reproduction start time t2, and so on.

Reproductive readout of the unit waveform is started at timing corresponding to each of the waveform events. The waveform sequence WS illustrated in FIG. 5 is arranged such that the timing data Dt0 and the waveform designating data AUW(5) (i.e., the data designating a waveform having the property of the attack portion waveform AUW) are stored as the first waveform event, the timing data Dt2 and the waveform designating data LW(12) (the data designating a waveform having the property of the loop waveform LW) are stored as the second waveform event, the timing data Dt3 and the waveform designating data IUW(8) (the data designating a waveform having the property of the loop waveform LW) are stored as the third waveform event, and so on.

Although the timing data has been described as indicating an absolute time, the present invention is not so limited, and the timing data may be one indicative of a relative time, a time difference between successive events, or the like; however, where the loop-reproduced waveforms are synthesized with each other by cross-fade, let it be assumed that the timing data indicates a cross-fading time, i.e., a length of a section over which the cross-fade synthesis is effected (cross-fading section).

The flow of the waveform formation processing shown in FIG. 6 is initiated such as when a waveform reproduction start instruction (e.g., selection or designation of a desired music piece) is received on the basis of automatic performance sequence data, for example, in the MIDI format.

Instruction designating music piece data and a specific range in the music piece data to be reproduced is received at first step S1 of FIG. 6. At next step S2, a determination is made as to whether a waveform sequence WS necessary for reproduction of the designated range of the music piece data is prestored in the above-mentioned waveform sequence memory section. If such a waveform sequence WS is prestored (YES determination at step S2), the program moves on to step S4, where a waveform formation process is carried out for forming and reproducing a waveform on the basis of the waveform sequence WS for the designated range. With a negative (NO) determination at step S2, i.e., if no such waveform sequence WS is prestored in the waveform sequence memory section, the necessary waveform sequence WS is created at step S3, and then a waveform is formed and reproduced at step S4 in accordance with the created waveform sequence WS.

Namely, the necessary waveform sequence WS is specified on the basis of the music piece data constructed, for example, in the MIDI format; in case such necessary waveform sequence WS has not been prepared beforehand, the waveform sequence WS is automatically created at step S3 in accordance with characteristics of the music piece data. The new waveform sequence WS may be created by selectively combining necessary waveforms; for example, when there is some overlap between note data (i.e., when a slur is detected), a slur rendition waveform is selected as a unit waveform to be used, or when the tone volume data indicates a gradually increasing or decreasing tone volume, a crescendo or decrescendo rendition waveform is selected, or when the pitch bend is varying over time, a pitch bend rendition waveform is selected which corresponds to a time variation curve of the pitch bend. Briefly, step S3 can be described as a step of converting the music piece data in the MIDI format or the like into a waveform sequence WS.

Note that although the waveform formation corresponding to the waveform sequence WS and the reproductive sound generation based on the waveform data generated in accordance with the waveform sequence WS are carried out through a series of operations in the described embodiment, such waveform data generated in accordance with the waveform sequence WS may be temporarily stored in a buffer memory so that a sound is audibly reproduced by reading out the waveform data from the buffer memory in response to a subsequent reproduction start instruction.

Figure 7:
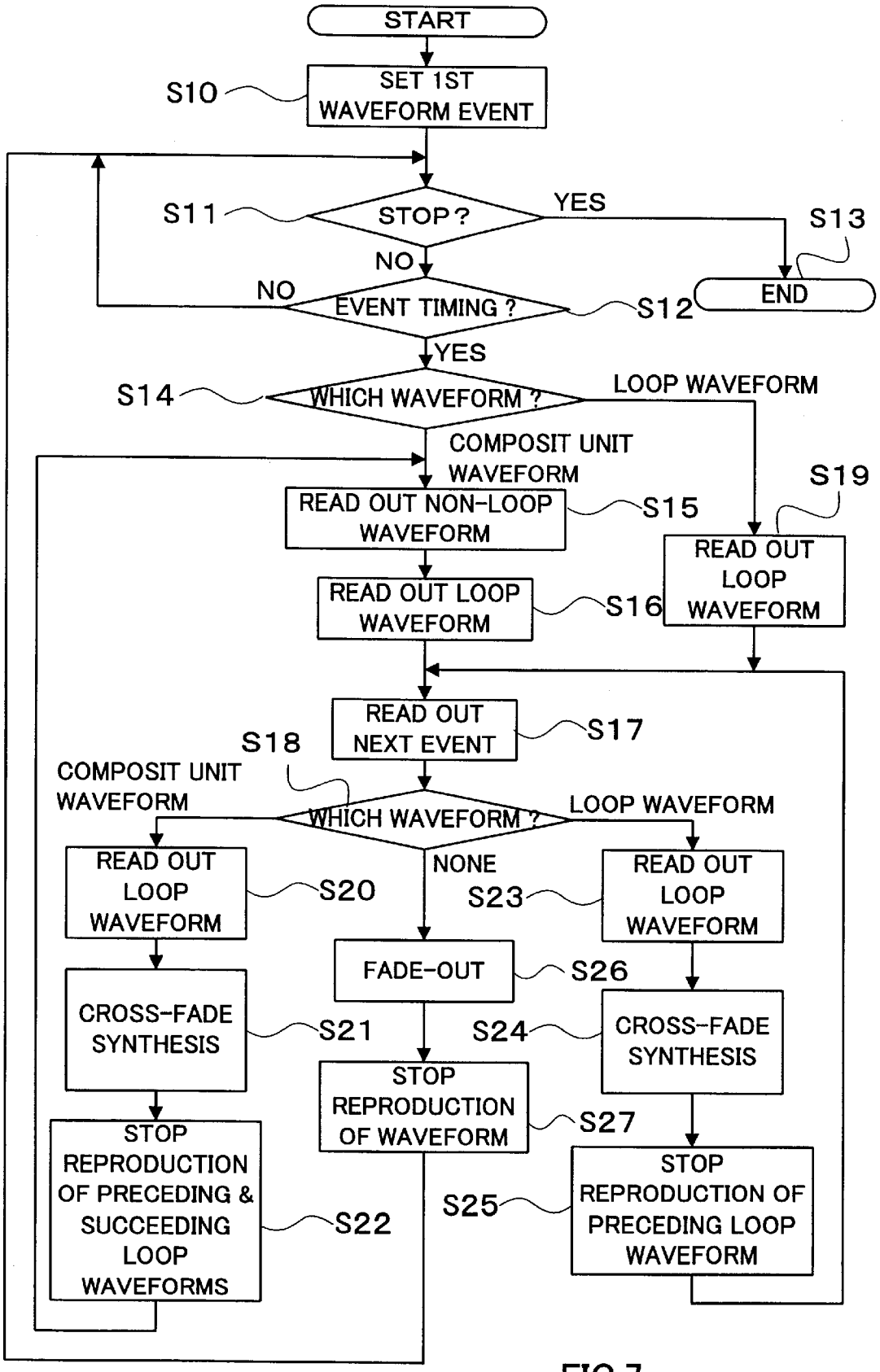
FIG. 7 is a flow chart showing an example of a waveform formation process carried out in the embodiment of the present invention.

FIG. 7 is a flow chart showing details of the waveform formation process carried out in the preferred embodiment at step S4 above.

At first step S10 of FIG. 7, the first waveform event in the waveform sequence WS is read out and set in a predetermined manner. In the illustrated example of FIG. 5, where the event associated with the timing data Dt0 is assumed to be the first waveform event in the waveform sequence WS, the timing data Dt0 and the waveform designating data AUW(5) are read out and set in a predetermined register. At next step S11, it is ascertained whether or not a stop instruction has been received. If answered in the negative (NO) at step S11, the program goes to step S12, where a further determination is made as to whether the event timing, i.e., sound-generation start timing, of the waveform event currently set in the register has arrived or not. Operation to be executed next is waited by looping between step S11 and S12 till receipt of the stop instruction or arrival at the sound-generation start timing. Once the sound-generation start timing has arrived, the program moves on to step S14 to make a further determination as to whether the waveform designating data set as the current waveform event designates a composite unit waveform or a loop waveform.

If the waveform designating data designates a composite unit waveform normally, an attack portion waveform AUW including a non-loop waveform segment NLW at its beginning, although any other type of composite unit waveform may be the first designated waveform as determined at step S14, the program goes to step S15. At this step S15, the waveform data of the non-loop waveform segment NLW are sequentially read out on the basis of the management data of this composite unit waveform. Once the readout of the waveform data of the non-loop waveform segment NLW has been completed, the program moves on to step S16 in order to read out the waveform data of the loop waveform segment LW immediately following the non-loop waveform segment NLW in the composite unit waveform. More specifically, at step S16, various management data for the loop waveform are read out from the management data area of the waveform memory WM and looped readout of the waveform data of the loop waveform LW is initiated on the basis of the read-out management data. Then, at next step S17, a next waveform event is read out from the waveform sequence memory section.

If the waveform designating data designates a simple loop waveform LW as determined at step S14, the program branches to step S19 to read out the waveform data of the loop waveform LW and then goes to step S17 to read out the next waveform event.

If the waveform sequence WS employed in the above-described waveform formation process is the one as shown in FIG. 5, then the waveform designating data occurring as the first waveform event designates the attack portion waveform AUW(5). Thus, the non-loop waveform segment NLW (i.e., the waveform segment starting at time point to in FIG. 8A) in the attack portion waveform AUW(5) is read out at step S15. Once the readout of the waveform data of the non-loop waveform segment NLW has been completed (at time point t1 of FIG. 8A), the program moves on to step S16 in order to read out the waveform data of the loop waveform segment LW immediately following the non-loop waveform segment NLW in the composite unit waveform.

At step S18, a determination is made as to whether the waveform designating data of the waveform event read out at step S17 above designates a composite unit waveform or a simple loop waveform LW (i.e., a unit waveform without a leading loop waveform segment LW), or whether such a waveform event is not preset at all. In the illustrated example of FIG. 5, the second waveform designating data designates a simple loop waveform LW(12), so that the program branches to step S23 in order to read out the waveform data of the designated simple loop waveform LW(12). At following step S24, a looped readout and cross-fade synthesis process is performed, where cross-fade synthesis effected between the two loop waveforms already read out, i.e., between the loop waveform segment at the end of the attack portion waveform AUW(5) read out at step S16 (namely, the "preceding loop waveform segment") and the loop waveform read out at step S23 (namely, the "succeeding loop waveform segment") while the respective waveform data of these two loop waveform segments are being read out in a looped fashion. This cross-fade synthesis is carried out over a time period designated by the timing data (Dt2 in the case of the second waveform data) contained in the event data read out at step S17 above. Upon lapse of the cross-fade time period, the reproductive readout of the preceding loop waveform segment is terminated at step S25, and then the program reverts to step S17 to read out a next or waveform event.

In the illustrated example of FIG. 5, the waveform designating data of the third waveform event designates an intermediate waveform IUW(8), so that step S18 determines that a composite unit waveform is being designated and then the program goes to step S20, where the preceding loop waveform segment in the composite unit waveform is read out similarly to step S23 above. At next step S21, a looped readout and cross-fade synthesis process is performed similarly to step S24 above. In this case, the loop waveform LW(12) that was the succeeding loop waveform segment in the last cross-fade synthesis becomes a new preceding loop waveform segment and the composite unit waveform newly read out at step S20 (the preceding loop waveform segment of the intermediate waveform IUW(8)) becomes a new succeeding loop waveform, so that the cross-fade synthesis is performed between these two loop waveform segments as they are read out in a looped fashion. This cross-fade synthesis is also carried out over a time period designated by the timing data (Dt3 in the case of the third waveform data) contained in the event data read out at step S17 above. Upon lapse of the designated cross-fade time period, the reproductive readout of the preceding and succeeding loop waveform segments is terminated at step S22, and then the program reverts to step S15 to read out the non-loop waveform segment NLW in the composite unit (in this case, the intermediate waveform IUW(8)). Once the readout of the waveform data of this non-loop waveform segment NLW has been completed, the program goes to step S16 in order to read out the waveform data of the loop waveform segment LW following the non-loop waveform segment NLW in the composite unit waveform, as mentioned above. Then, the program moves on to step S17 to repeat the above-described operations. Thus, the loop waveform LW(3), intermediate waveform IUW(7) and release portion waveform RUW(1) are sequentially read out and connected together by cross-fade synthesis in a similar manner to the above-mentioned.

After the non-loop waveform segment of the release portion waveform RUW(1) has been read out as a last waveform event in the waveform sequence WS, the program jumps over step S16 to step S17 because no further loop waveform segment is present in the release portion waveform. Because there is no further waveform event in the waveform sequence WS in this case, the program proceeds to step S26 to perform a fade-out process on the waveform being currently reproduced, during which time the reproductive waveform readout is terminated to stop the sound generation at step S27. After that, the program reverts to step S11 so that any operation to be executed next is waited by the loop between step S11 and S12 till receipt of the stop instruction STOP or arrival at next sound-generation start timing. Once the next sound-generation start timing of the waveform sequence WS has arrived, an affirmative (YES) determination is made at step S12 so that the above-described operations are repeated to carry out the reproduction process of the corresponding waveform. Then, when the reproduction of the music piece data range designated at step S1 has been completed by the sequential reproduction of the waveform sequence, or when a stop operation has been made by the user via the input operator unit 1 of FIG. 1, an affirmative (YES) determination is made at step S11, so that the waveform formation process is terminated at step S13.

Figures 8A, 8B, 8C, 8D:
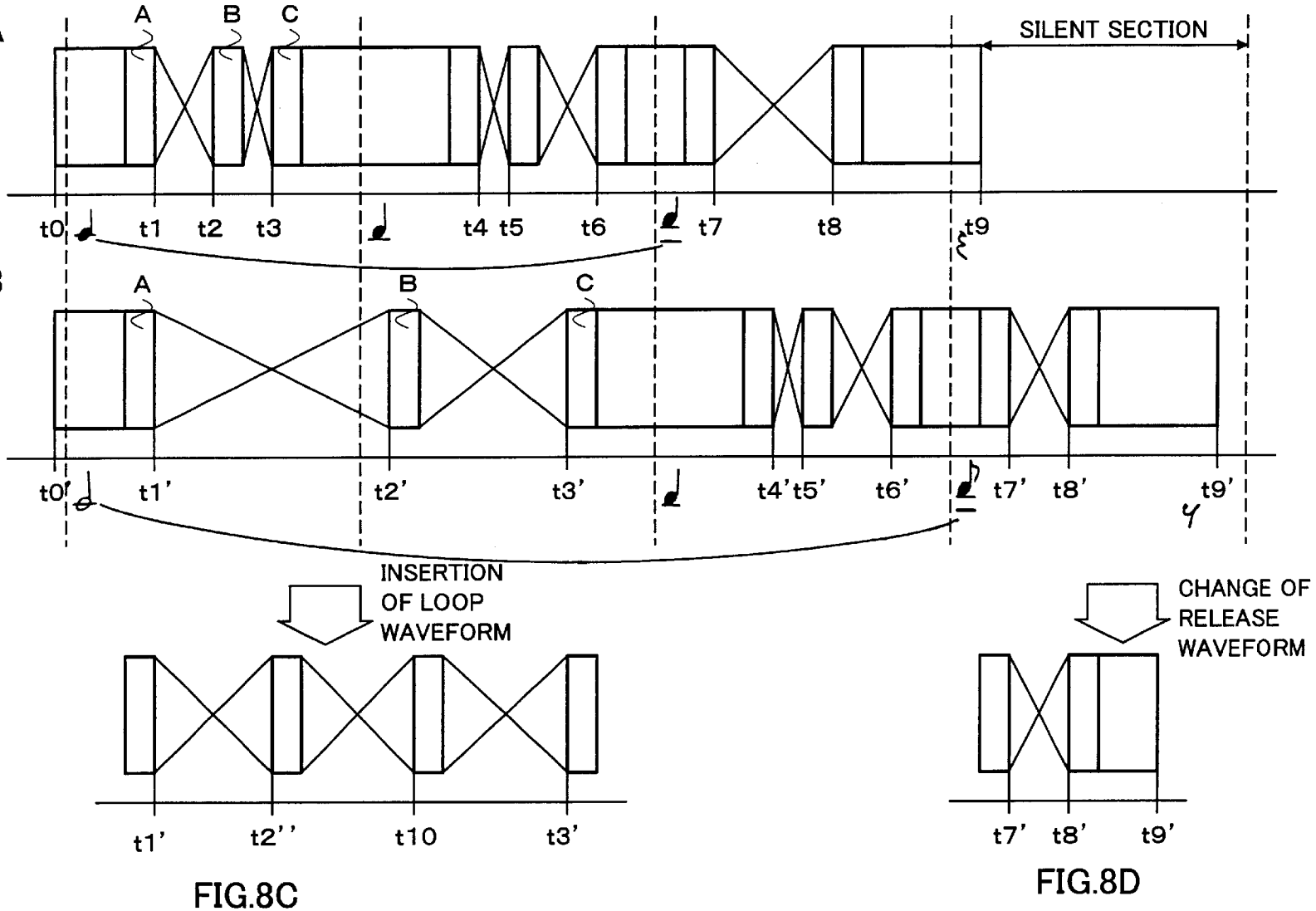
FIGS. 8A to 8D are conceptual waveform diagrams explanatory of examples of TSC control carried out in the embodiment of the present invention.

The following paragraphs more fully describe an exemplary manner in which the preceding and succeeding loop waveform segments are cross-fade synthesized while the two loop waveform segments are being reproduced in a looped fashion (read out repeatedly), with reference to loop waveform segments A, B and C as shown in FIG. 8A. FIG. 8A shows an example of a tone waveform generated through six waveform events indicated in the waveform sequence WS of FIG. 5.

In this case, in a cross-fading section from time point t1 to time point t2, the preceding loop waveform segment A (i.e., the loop waveform segment in the attack portion waveform AUW(5) designated by the waveform sequence WS) is read out and simultaneously the succeeding loop waveform segment B (i.e., the loop waveform LW(12)) is read out, and the loop-reproduced waveform based on the preceding loop waveform segment A is controlled in its amplitude by an envelope having a fade-out (falling) characteristic and the loop-reproduced waveform based on the succeeding loop waveform B is controlled in its amplitude by an envelope having a fade-in (rising) characteristic, so that the resultant amplitude-controlled waveforms are additively synthesized to produce a single loop-reproduced waveform. The loop-reproduced waveform thus produced by the cross-fade synthesis will present a smooth change from the loop waveform segment A to the other loop waveform segment B. This process is carried out at step S24 of FIG. 7. As noted earlier, the cross-fading time, i.e., cross-fading section length, in this case is specified by the timing data Dt2 contained in the event data for the succeeding loop waveform segment B. That is, within the cross-fading section from the start point t1 to the end point t2 specified by the timing data Dt2, the cross-fade coefficient of the fade-out characteristic for the preceding loop waveform segment A is caused to linearly fall from a maximum value "1" to a minimum value "0", while the cross-fade coefficient of the fade-in characteristic for the succeeding loop waveform segment B is caused to linearly rise from a minimum value "0" to a maximum value "1". By variably controlling the timing data Dt2 in accordance with predetermined time-axial stretch/compression control information, the cross-fade end point t2 can be moved forward (or backward) to point t2' as illustrated in FIG. 8B so that the cross-fading section length for the loop waveform cross-fade synthesis can be freely controlled to be stretched or compressed along the time axis. Note that the timing data designating the cross-fading section length may be expressed as coefficient data indicative of an inclination of a cross-fade curve.

More specifically, in the looped readout executed at step S16 and S19 of FIG. 7 above, the readout of the loop waveform (i.e., the preceding loop waveform segment) is initiated with the above-mentioned cross-fade coefficient set to the maximum value "1". In the looped readout executed at step S20 and S23 of FIG. 7, on the other hand, the readout of the loop waveform (i.e., the succeeding loop waveform segment) is initiated with the above-mentioned cross-fade coefficient set to the minimum value "0". Then, at steps S21 and S24, the preceding and succeeding loop waveform segments are cross-fade synthesized while the two loop waveform segments are being reproduced in a looped fashion.

In a next cross-fading section from time point t2 to time point t2 of FIG. 8A, the loop waveform segment B, which was the succeeding loop waveform segment in the last cross-fading section, is switched to a new preceding loop waveform segment and is controlled in its amplitude by an envelope having a fade-out (falling) characteristic as it continues to be read out in a looped fashion. Simultaneously, the succeeding loop waveform segment of the intermediate waveform IUW(8) is set as a new succeeding loop waveform segment and is controlled in its amplitude by an envelope having a fade-in (rising) characteristic as it is read out in a looped fashion. Thus, the resultant amplitude-controlled loop-reproduced waveforms based on these loop waveform segments are additively synthesized to produce a single loop-reproduced waveform. This process is carried out at step S21 of FIG. 7. As noted earlier, the cross-fading time, i.e., cross-fading section length, in this case is specified by the timing data Dt3 contained in the event data for the next loop waveform segment C. In this case too, by variably controlling the timing data Dt3 in accordance with predetermined time-axial stretch/compression control information, the cross-fade end point t3 can be moved forward (or backward) to point t3' as illustrated in FIG. 8B so that the cross-fading section length for the loop waveform cross-fade synthesis can be freely controlled to be stretched or compressed along the time axis.

According to the preferred embodiment of the present invention, control for reading out waveform data with its time axis stretched or compressed over a desired range thereof is executed independently of pitch control of each tone to be generated, and such control will hereinafter be called "time-axial stretch/compression control" and abbreviated "TSC control". The preferred embodiment is arranged to permit free and diversified control of characteristics of tones to be generated, using the time-axial stretch/compression or TSC control. The following are some specific examples of control over various styles of rendition or tonal effects using the TSC control:

(1) Controlling a cycle of a periodic modulation effect such as a vibrato or tremolo;

(2) Controlling a time length of a time-varying pitch modulation effect such as a pitch bend;

(3) Controlling a time of a rising or falling portion of a sound such as an attack or decay portion;

(4) Positively and freely imparting "fluctuations" to a tone;

(5) Eliminating monotonousness of loop control (including control of looped readout for formation of a sustain sound or loop control of a vibrato);

(6) Controlling a connecting time over which control is performed to connect together successive tones as by a slur;

(7) Controlling a length of an ornament;

(8) Compensating for a variation in a sound generation time when a prestored original waveform is read out at a different pitch, (9) Reading out a prestored original waveform with its time axis controlled locally or partially, to create various variations of a sound from the original waveform; and

(10) Reading out a prestored original waveform with its entire sound generating length variably controlled, to thereby optionally control the generation length of a sound based on the original waveform (e.g., adjust the sound generation length to coincide with a note length defined on a musical staff supplied by automatic performance information).

Now, the TSC control will be described in detail with reference to FIG. 8. Specifically, FIG. 8A conceptually shows an original waveform before being subjected to the TSC control and FIG. 8B conceptually shows the waveform after having been subjected to the TSC control, in each of which the horizontal axis is the time axis. In the lower portion of each of these figures, there are shown note data on a musical staff represented by the waveform. As will be seen from a slur mark attached to all the note data, the waveform data indicated by these note data represent a waveform of a continuing sound.

More specifically, FIG. 8A shows an example of a tone waveform generated in accordance with the six waveform events contained in the waveform sequence WS of FIG. 5. This tone waveform is made up of one attack portion waveform (AUW(5)), two intermediate waveforms (IUW(8) and IUW(7)), one release portion waveform (RUW(1)) and two loop waveforms (LW(12) and LW(3)), all of which are stored as waveform events in a single waveform sequence WS.

The waveform sequence WS contains the data indicative of the respective predetermined reproduction start time points of the individual unit waveforms as shown in FIG. 5, and these reproduction start time points are denoted immediately below the corresponding unit waveforms in FIG. 8. More specifically, at time point t0, reproduction of the attack portion waveform (AUW(5)) of a quarter note "C" is initiated. At time point t2, reproduction of the loop waveform LW(12), which constitutes a sustain waveform of the above-mentioned note "C", is initiated. At time point t3, reproduction of the intermediate waveform IUW(8), which is generated by connecting, by a slur rendition, a release waveform of the note "C" and an attack waveform of a next note "D", is initiated. Then, at time point t5, reproduction of the loop waveform LW(3), which constitutes a sustain waveform of the above-mentioned note "D", is initiated, and at time point t6, reproduction of the intermediate waveform IUW(7), which is generated by connecting, by a slur rendition, a release waveform of the above-mentioned note "D" and an attack waveform of a next note "E", is initiated. Finally, at time point t8, reproduction of the release portion waveform (RUW(1)), which constitutes a release waveform of the above-mentioned note "E", is initiated. In this way, the waveforms are reproduced one after another, during which time the cross-fade synthesis is executed between the individual looped regions to smooth the connection or synthesis between the waveforms.

The cross-fade synthesis may be carried out in any one of various specific ways. In the preferred embodiment of the present invention, as noted earlier, two loop waveforms are cross-fade synthesized as they are read out from the waveform memory in a looped fashion. The way of executing the cross-fade synthesis (including setting of the relationship between the fade-in and the fade-out and a characteristic of the cross-fade function), however, is not limited to that described above in relation to the preferred embodiment and may be modified variously as desired. Carrying out such cross-fade synthesis is very preferable but not necessarily essential to the present invention; that is, the TSC control can be applied to just variably control a looped reproduction time of a single loop waveform.

Because the waveform sequence WS includes the timing data for each of the waveform event and the reproduction starting time point and reproduction time length of each of the waveform event is determined by the corresponding timing data, the TSC control can be performed by varying the timing data. In applying the time-axial stretch/compression control to stretch or compress the reproduction time, a time-axial stretch/compression ratio Crate indicative of a stretch/compression ratio to a standard reproduction time is used as a parameter. Here, the terms "standard reproduction time" refers to the time length of the original waveform, i.e., the time length when the original waveform is not subjected to the time-axial stretch/compression and reproduced with no pitch-up or pitch-down.

More specifically, the above-mentioned time-axial stretch/compression ratio Crate is a parameter meaning that "the reproduction time length of an output waveform is set to be 1/Crate of the reproduction time length of the original waveform having been controlled in pitch. Of course, the time-axial stretch/compression ratio Crate can be varied in real time even during the course of waveform readout (sound generation) operation, rather than being fixed to a constant value, so that it assumes the above-mentioned significance from a local viewpoint. The time-axial length of the output waveform will be left unchanged in its time-axial length when the ratio Crate is "1.0", compressed when the ratio Crate is greater than "1.0", and stretched when the ratio Crate is smaller than "1.0", and.

In the example of FIG. 8B, the TSC control is applied to looped readout sections of the waveform. Namely, FIG. 8B shows a case where the reproduction time lengths between time points t1 and t2 and between time points t2 and t3 in the waveform of FIG. 8A have been stretched to reproduction time lengths between time points t1' and t2' and between time points t2' and t3', respectively, and the reproduction time length between time points t7 and t8 in the waveform of FIG. 8A has been compressed to a reproduction time length between time points t7' and t8'. Namely, the above-mentioned waveform synthesis/reproduction process has been executed here using the time-axial stretch/compression ratio Crate greater than "1.0" for the section between time points t1 and t2 and between time points t2 and t3, using the ratio Crate smaller than "1.0" for the section between time points t7 and t8, and using the ratio Crate of "1.0" for the remaining sections. In this manner, the TSC control can be performed with considerable ease.

Now, lets assume a case where that the original waveform sequence WS shown in FIG. 8A corresponds to a performance phrase of music piece data made up of three quarter notes "C", "D" and "E" and a quarter rest as denoted immediately below the waveform, and the performance phrase has been changed into another performance phrase made up of a half note "C", a quarter note "D", an eighth note "E" and an eighth rest as shown in FIG. 8B. In such a case, the time-axial stretch/compression control is applied to individual desired looped reproduction sections in response to the changes of the individual notes, so that only the time lengths of the looped reproduction sections can be controlled to be stretched or compressed without changing the reproduction pitch at all. Further, the performance phrase of the original waveform sequence WS can be variably controlled on a real time or non-real time basis during a reproductive performance, by executing the time-axial stretch/compression control in various manners. If the time-axial stretch/compression control is applied in response to a change of each of the three quarter notes "C", "D" and "E" into the eighth note length or into the half note length, control can be effected to substantially raise or lower the performance tempo. Note that the present invention can control tones to be generated in an even more diversified manner because it is arranged to control the tone pitch by controlling the waveform readout rate simultaneously with and independently of the time-axial stretch/compression or TSC control of the waveform based on the above-mentioned ratio Crate.

For the loop waveform, the total time length of the entire loop-reproduced waveform can, in principle, be variably controlled independently of the tone reproduction pitch relatively easily, by varying the number of readout loops to be effected or duration of the readout loops. Namely, in this case, a particular inclination of a cross-fade curve is determined as the cross-fading section length is specified by the timing data Dt, so that by variably controlling the inclination of the specified cross-fade curve (or the value of the timing data Dt) in accordance with time-axial stretch/compression ratio data Crate, the cross-fade speed is variably controlled, as a result of which the time length of the cross-fading section can be variably controlled. Because the tone reproduction pitch is not influenced at all during the TSC control, the variable control of the number of readout loops eventually results in variable control of the time length of the cross-fading section (i.e., loop reproduction section).

For the non-loop waveform, on the other hand, it is not so easy to variably control the time-axial length or duration of the waveform independently of the tone reproduction pitch. Thus, for such a waveform of a continuing sound that is comprised of a non-loop waveform and a loop waveform as mentioned above, the arrangement for variably controlling the entire sound-generation time length by variably controlling the time lengths of the individual looped readout sections is extremely preferable in that the arrangement greatly facilitates the time-axial stretch/compression control. Further, for some given non-loop waveform corresponding to a special style of rendition, varying the time-axial length of a particular section may lead to an unpreferable effect. However, there has been a demand in the art that the time-axial stretch/compression control be applied to even a tone waveform containing such a non-loop waveform segment; to meet the demand, it should be very effective to apply the time-axial stretch/compression control only partially to the loop waveform segment, not to the non-loop waveform segment.

The time-axial stretch/compression control of the non-loop waveform, however, can be performed with ease by employing a novel technique for "time-axial stretch/compression control of waveform data" that has already been proposed in another patent application (Japanese Patent Application No. HEI-9-130394) filed by the assignee of the present application. Briefly, the proposed time-axial stretch/compression control technique is characterized in that to compress the time-axial length or duration of the non-loop waveform composed of a given quantity of waveform data while still maintaining a predetermined reproduction sampling frequency and a predetermined reproduction pitch, the waveform data are read out with appropriately selected ones of the data skipped, while to stretch the time-axial length of the non-loop waveform, the waveform data are read out with appropriately selected ones of the data repeated. The proposed novel time-axial stretch/compression control technique also subjects the read-out waveform data to cross-fade synthesis, in order to eliminate undesirable discontinuousness resulting from the skip or repetition of some of the waveform data. Although not fully explained here, such a novel approach may also be applied to the non-loop waveform readout process (step S15 of FIG. 7) to perform the TSC control on the non-loop waveform segment in the described embodiment.

Figure 9:
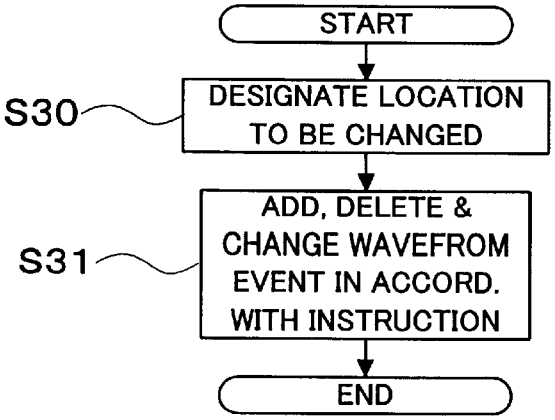
FIG. 9 is a flow chart showing an example of a waveform editing process for editing waveform sequence data in the embodiment of the present invention.

Further, according to the embodiment of the present invention, the various data in the waveform sequence WS can be edited as desired. FIG. 9 is a flow chart showing an example of a waveform editing process directed to the editing of the waveform sequence data.

At first step S30 of the waveform editing process, designation is first made of a particular location in the waveform sequence WS where the unit waveform data should be varied as desired or other waveform data should be added. Then, at step S31, the waveform sequence WS is varied such as by replacing the unit waveform data stored in the designated location (i.e., designated unit waveform data) with other unit waveform data, deleting the designated unit waveform data, or adding new unit waveform data to the designated location.

For example, even a given intermediate waveform, specified in the already-created waveform sequence WS, including a non-loop waveform segment can be readily changed into another intermediate waveform (e.g., an intermediate waveform shown at the bottom of FIG. 4), because it also includes loop waveform segments immediately before and after the non-loop waveform segment (as in an intermediate waveform shown in the middle of FIG. 4). Further, the release portion waveform RUW can also be replaced, as shown in FIG. 8D. Furthermore, a new loop waveform segment can be added to the designated location, as shown in FIG. 8C. The reason why the unit waveforms can be easily changed as desired is the use of the novel waveform data format of the present invention.

Figure 10:
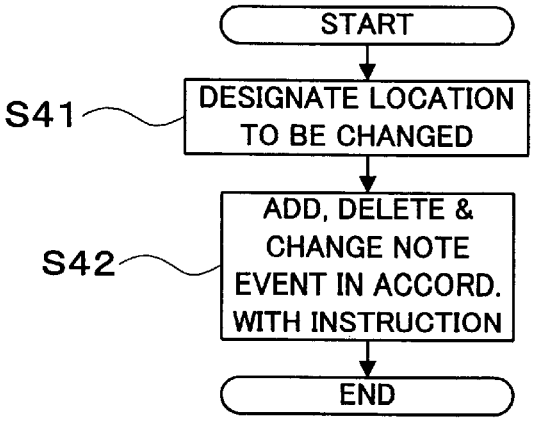
FIG. 10 is a flow chart showing an example of a note sequence editing process for editing note sequence data in the embodiment of the present invention.

A plurality of waveform sequences WS are designated in accordance with a note sequence (automatic performance sequence) corresponding to the music piece data. For example, a single waveform sequence WS may be designated in response to a single note event, or a single waveform sequence WS may be designated in response to a plurality of successive note events involving a special style of rendition such as a slur as in the illustrated example of FIG. 8A, or a plurality of waveform sequences WS may be designated in response to a single note event. Each of such a note sequence may also be edited by the user as necessary. FIG. 10 is a flow chart showing an example of a note sequence editing process directed to editing the note sequence.

At first step S40 of the note sequence editing process, designation is first made of a particular location in the note sequence where the note event should be varied as desired or another or new note event should be added. Then, at step S41, the note sequence is varied such as by replacing the note event stored in the designated location (i.e., designated note event) with another note event, deleting the designated note event, or adding a new note event to the designated location. When an instruction is given to reproduce music piece data having its note sequence newly edited, no waveform sequence WS corresponding to the edited portion has been prepared yet, so that a negative (NO) determination is made at step S2 of FIG. 6 and thus the waveform sequence WS corresponding to the edited portion is prepared at following step S3. In the event only a portion of the music piece data has been edited, step S3 newly creates part of the corresponding waveform sequence WS which corresponds to that edited portion and the waveform sequence WS already created in the past can be used for the remaining portion of the music piece data.

For example, in the waveform sequence WS corresponding to the waveform of FIG. 8B, the note sequence of three quarter notes "C", "D" and "E" and a quarter rest corresponding to the waveform of FIG. 8A has been edited, via the above-mentioned note sequence editing process, into a note sequence of a half note "C", a quarter note "D", an eighth note "E" and an eighth rest (i.e., a change of note events). Because no waveform sequence WS corresponding to the edited note sequence has been prepared yet, so that the waveform sequence WS corresponding to the edited note sequence is newly prepared at step S3 of FIG. 6.

Note that in the waveform formation processing program of FIG. 7, the waveform sample data readout process at steps S15, S21, S24, etc. may be executed in any desired manner. For example, as an interrupt process per cycle of a predetermined reproduction sampling frequency, one sample of waveform data according to the reproduction sampling frequency may be read out for formation of a waveform. Alternatively, as well known as the software tone generator technique proposed by the assignee of the instant application, the present invention may be arranged such that a multiplicity of samples of waveform data corresponding to a single frame section are formed collectively within a short time period and stored in an output buffer and then readout of the waveform sample data from the output buffer is executed every cycle of the reproduction sampling frequency. Further, the waveform formation processing of the present invention is not limited to the software-based processing and may also be executed by a DSP device arranged to operate on the basis of microprograms directed to the same waveform formation processing as executed in the above-described embodiment. In another alternative, dedicated hardware circuitry may be constructed so that it performs the same waveform formation processing as in the above-described embodiment via an LSI or discrete circuit.

In summary, the present invention is characterized in that the waveform data of the unit waveforms stored in the storage section include first and second loop waveform segments at both ends of a non-loop waveform segment. Thus, by connecting the read-out unit waveform with another waveform preceding or following the read-out unit waveform using the first or second loop waveform segment in the read-out unit waveform, waveform formation is permitted through a sequential combination of unit waveforms. Namely, the non-loop waveform which is a high-quality waveform having characteristics of articulation (style of rendition) and the like, can be easily connected with any other waveform, to thereby permit free waveform formation. Thus, the present invention affords the superior benefit that it permits good-quality waveform formation, taking articulation (style of rendition) of a sound into account.

As a consequence, if a high-quality waveform having characteristics of a desired articulation (style of rendition), tonal effect or the like, such as a waveform with a vibrato, tremolo or other modulation imparted thereto, a waveform with a pitch bend or other pitch modulation imparted thereto, or a waveform with a slur imparted thereto, is used as the non-loop waveform, the present invention can enhance the efficiency of use of such a high-quality waveform by effecting free waveform formation through a facilitated combination between the high-quality waveform and another waveform. As a result, the present invention affords the superior benefit that it permits good-quality waveform formation, taking articulation (style of rendition) of a sound into account, in a manner rich in controllability and editability.

Further, by combining the unit waveform data including the loop waveform and non-loop waveform segments with another set of waveform data via their respective loop waveform segments, the present invention can easily combine a non-loop waveform, which is a high-quality waveform having characteristics of articulation (style of rendition) and the like, with any other waveform, to thereby permit free waveform formation, similarly to the above-mentioned; thus, the present invention affords the superior benefit that it permits good-quality waveform formation, taking articulation (style of rendition) of a sound into account, in a manner rich in controllability and editability. In addition, when cross-fade synthesis is performed between loop-reproduced waveforms based on the two waveforms in their connecting sections, the present invention allows the time length of the cross-fade synthesis to be freely controlled in accordance with time control information, so that the total time axial length or duration of a tone waveform to be formed can be variably controlled freely and independently of the pitch of the tone waveform. As a consequence, time-axial stretch/compression control can be suitably employed in order to carry out good-quality waveform formation taking articulation (style of rendition) of a sound into account, which can further increase the controllability.

Furthermore, the present invention is characterized in that the waveform data readout is controlled to be stretched or compressed along the time axis in a given portion (whole or part) of a tone independently of the readout rate control (pitch control of the tone to be generated) to thereby control the tone generation time length or duration in that given portion. With this arrangement, the present invention provides for tone generation rich in expression and controllability that was not possible in the past. For example, the present invention can freely variably control the time length of rising or falling portion of a generated tone, or freely control the time length of a generated tone in conformity to a note length etc. by variably controlling the total time length of the entire generated tone while maintaining a desired pitch of the tone.

What is claimed is:

1. A waveform generating device comprising:

a storage section storing sets of waveform data of unit waveforms in such a way that any one of said unit waveforms can be selectively readout from said storage section, each of said unit waveforms including a first loop waveform segment to be read out in a repeated fashion, a non-loop waveform segment to be read out in a non-repeated fashion which follows said first loop waveform segment and a second loop waveform segment to be read out in a repeated fashion which follows said non-loop waveform segment; and a waveform formation section for selecting and reading out the waveform data of one of said unit waveforms, and connecting the read-out unit waveform with another waveform preceding or following the read-out unit waveform to thereby form a waveform of at least part of a sound, wherein said another waveform includes a loop waveform segment at at least one end thereof that is to be connected to said unit waveform, and wherein the loop waveform segment of said another waveform is connected to said first or second loop waveform segment in the read-out unit waveform.

2. A waveform generating device as recited in claim 1 wherein the other waveform is generated by repeatedly reading out a loop waveform.

3. A machine-readable medium storing a plurality of sets of waveform data including sets of waveform data of unit waveforms selectable independently of each other, wherein at least one of said unit waveforms integrally includes a first loop waveform segment to be read out in a repeated fashion, a non-loop waveform segment to be read out in a non-repeated fashion which follows said first loop waveform segment and a second loop waveform segment to be read out in a repeated fashion which follows said non-loop waveform segment.

4. A waveform generating device comprising:

a storage section storing first unit waveform data including a non-loop waveform segment to be read out in a non-repeated fashion and at least one loop waveform segment to be read out in a repeated fashion which connects to at least one of front and rear ends of the non-loop waveform segment, and second unit waveform data including at least one loop waveform segment to be read out in a repeated fashion, one of said first and second unit waveform data being capable of being selectively read out from said storage section; and a waveform formation section for selecting and reading out said first and second unit waveform data in succession, during which time said waveform formation section repeatedly reads out the loop waveform segments of said first and second unit waveform data in a looping time section and executes cross-fade synthesis between the repeatedly read-out loop waveform segments of said first and second unit waveform data, to thereby form a waveform of at least part of a sound, said waveform formation section controlling a time length of the cross-fade synthesis in accordance with time control information.

5. A waveform generating device comprising:

a storage section storing waveform data of a tone waveform corresponding to a phrase performance containing a plurality of musical notes, said tone waveform including one or more non-loop waveform segments to be read out in a non-repeated fashion and loop waveform segments to be read out in a repeated fashion, said tone waveform including at least one said loop waveform segment for each individual one of the notes; and a waveform readout section for reading out the waveform data of each segment of said tone waveform in a predetermined sequence from said storage section, said waveform readout section reading out the waveform data of each of the non-loop waveform segments only once and reading out the waveform data of each of the loop waveform segments repeatedly, said waveform readout section variably controlling a time length of repeated readout of the loop waveform segment corresponding to a specific one of the notes, to thereby variably control a time length of the specific note in such a manner that a total time length of the phrase performance is variably controlled.

6. A waveform generating device as recited in claim 5 wherein the loop waveform segment corresponding to a looping section in said tone waveform includes a first loop waveform segment and a second loop waveform segment which follows said first loop waveform segment, and wherein said waveform readout section repeatedly reads out said first and second loop waveform segments in a looping time section and executes cross-fade synthesis between the repeatedly read-out first and second loop waveform segments.

7. A waveform generating device as recited in claim 5 wherein said tone waveform includes a waveform section corresponding to at least two successive notes, and a waveform segment in said waveform section corresponding to a special style of rendition in a connecting portion between the notes is formed by the non-loop waveform segment.

8. A method comprising:

a step of providing a memory storing sets of waveform data of unit waveforms in such a way that the waveform data of any one of said unit waveforms can be selectively readout from said memory, each of said unit waveforms including a first loop waveform segment to be read out in a repeated fashion, a non-loop waveform segment to be read out in a non-repeated fashion which follows said first loop waveform segment and a second loop waveform segment to be read out in a repeated fashion which follows said non-loop waveform segment;

a step of selecting and reading out the waveform data of one of said unit waveforms; and a step of connecting the read-out unit waveform with another waveform preceding or following the read-out unit waveform to thereby form a waveform of at least part of a sound, wherein said another waveform includes a loop waveform segment at at least one end thereof that is to be connected to said unit waveform, and wherein the loop waveform segment of said another waveform is connected to said first or second loop waveform segment in the read-out unit waveform.

9. A method comprising:

a step of providing a memory storing first unit waveform data including a non-loop waveform segment to be read out in a non-repeated fashion and at least one loop waveform segment to be read out in a repeated fashion which connects to at least one of front and rear ends of the non-loop waveform segment, and second unit waveform data including at least one loop waveform segment to be read out in a repeated fashion, one of said first and second unit waveform data being capable of being selectively read out from said memory;

a readout step of selecting and reading out said first and second unit waveform data in succession, during which time said readout step repeatedly reads out the loop waveform segments in a looping time section;

a step of executing cross-fade synthesis between the loop waveform segments of said first and second unit waveform data repeatedly read out by said readout step in the looping time section and thereby connecting together waveforms based on said first and second unit waveform data; and a step of controlling a time length of the cross-fade synthesis in accordance with time control information, wherein a waveform of at least part of a sound is formed by combining together a waveform based on said first unit waveform data including the non-loop waveform segment read out in a non-repeated fashion and the loop waveform segment read out in a repeated fashion for connection to the at least one of front and rear ends of the non-loop waveform segment and a waveform based said second unit waveform data including the loop waveform segment read out in a repeated fashion.

10. A waveform generating method comprising:

a step of providing a memory storing waveform data of a tone waveform corresponding to a phrase performance containing a plurality of musical notes, said tone waveform including one or more non-loop waveform segments to be read out in a non-repeated fashion and loop waveform segments to be read out in a repeated fashion, said tone waveform including at least one said loop waveform segment for each individual one of the notes;

a readout step of reading out the waveform data of each segment of said tone waveform in a predetermined sequence from said storage memory, said readout step reading out the waveform data of each of the non-loop waveform segments only once and reading out the waveform data of each of the loop waveform segments repeatedly; and a step of variably controlling a time length of repeated readout of the loop waveform segment corresponding to a specific one of the notes, to thereby variably control a time length of the specific note in such a manner that a total time length of the phrase performance is variably controlled.

11. A machine-readable medium containing a group of instructions of a program executable by a processor for generating a waveform based on waveform data stored in a memory, said memory storing a plurality of sets of waveform data including waveform data of independently selectable unit waveforms, at least one of the unit waveforms integrally including a first loop waveform segment to be read out in a repeated fashion, a non-loop waveform segment to be read out in a non-repeated fashion which follows said first loop waveform segment and a second loop waveform segment to be read out in a repeated fashion which follows said non-loop waveform segment, said program comprising:

a step of selecting one of the sets of waveform data to be read out from said memory;

a readout step of reading out, from said memory, one of the sets of waveform data selected by said step of selecting; and a step of, when the set of waveform data selected by said step of selecting is the waveform data of the unit waveform integrally including said first and second loop waveform segments, connecting the unit waveform with another waveform preceding or following the unit waveform to thereby form a waveform of at least part of a sound, wherein said another waveform includes a loop waveform segment at at least one end thereof that is to be connected to said unit waveform, and wherein the loop waveform segment of said another waveform is connected to at least one of said first and second loop waveform segments in the unit waveform.

12. A machine-readable medium containing a group of instructions of a program executable by a processor for generating a waveform based on waveform data stored in a memory, said memory storing a plurality of sets of waveform data including waveform data of independently selectable unit waveforms, a first one of the unit waveforms integrally including a non-loop waveform segment to be repeated in a non-repeated fashion and at least one loop waveform segment to be read out in a repeated fashion which connects to at least one of front and rear ends of the non-repeated fashion, a second one of the unit waveforms including at least one loop waveform segment to be read out in a repeated fashion, said program comprising:

a step of selecting one of the sets of waveform data to be read out from said memory;

a readout step of reading out, from said memory, the set of waveform data selected by said step of selecting, wherein when the sets of waveform data of said first and second unit waveforms are to be read out in succession, said readout step repeatedly reading out the loop waveform segments of said first and second unit waveforms in a looping time section;

a step of executing cross-fade synthesis between the loop waveform segments of said first and second unit waveforms repeatedly read out by said readout step in the looping time section, to thereby connect together waveforms based on said first and second unit waveforms; and a step of controlling a time length of the cross-fade synthesis in accordance with time control information, wherein a waveform of at least part of a sound is formed by combining together the waveform based on said first unit waveform including the non-loop waveform segment read out in a non-repeated fashion and the loop waveform segment read out in a repeated fashion for connection to the at least one of front and rear ends of the non-loop waveform segment and the waveform based said second unit waveform including the loop waveform segment read out in a repeated fashion.

13. A machine-readable medium containing a group of instructions of a program executable by a processor for generating a waveform based on waveform data stored in a memory, said memory storing at least waveform data of a tone waveform corresponding to a phrase performance containing a plurality of musical notes, said tone waveform including one or more non-loop waveform segments to be read out in a non-repeated fashion and loop waveform segments to be read out in a repeated fashion, said tone waveform including at least one said loop waveform segment for each individual one of the notes, said program comprising:

a readout step of reading out the waveform data of each segment of said tone waveform in a predetermined sequence from said storage memory, said readout step reading out the waveform data of each of the non-loop waveform segments only once and reading out the waveform data of each of the loop waveform segments repeatedly; and a step of variably controlling a time length of repeated readout of the loop waveform segment corresponding to a specific one of the notes, to thereby variably control a time length of the specific note in such a manner that a total time length of the phrase performance is variably controlled.

14. A waveform generating device comprising:

a memory storing sets of waveform data including waveform data of independently selectable unit waveforms, at least one of the unit waveforms integrally including a first loop waveform segment to be read out in a repeated fashion, a non-loop waveform segment to be read out in a non-repeated fashion which follows said first loop waveform segment and a second loop waveform segment to be read out in a repeated fashion which follows said non-loop waveform segment; and a processor connected at least to said memory, and adapted to select and read out, from said memory, said unit waveform integrally including the first loop waveform segment, the non-loop waveform segment and the second loop waveform segment, connecting the read-out unit waveform with another waveform preceding or following the read-out unit waveform data to thereby form a waveform of at least part of a sound, wherein said another waveform includes a loop waveform segment at at least one end thereof that is to be connected to said unit waveform, and wherein the loop waveform segment of said another waveform is connected to said first or second loop waveform segment in the read-out unit waveform.

15. A waveform generating device comprising:

a memory storing sets of waveform data including waveform data of independently selectable unit waveforms, a first one of the unit waveforms integrally including a non-loop waveform segment to be repeated in a non-repeated fashion and at least one loop waveform segment to be read out in a repeated fashion which connects to one of front and rear ends of the non-repeated fashion, a second one of the unit waveforms including at least one loop waveform segment to be read out in a repeated fashion, said program comprising;

a processor connected at least to said memory, and adapted to select and read out, from said memory, one of said unit waveforms, wherein when the waveform data of said first and second unit waveforms are read out in succession, said processor repeatedly reads out the loop waveform segments of said first and second unit waveforms in a looping time section and executes cross-fade synthesis between the repeatedly read-out loop waveform segments of said first and second unit waveforms, to thereby connect together waveforms based on said first and second unit waveforms, said processor also controlling a time length of the cross-fade synthesis in accordance with time control information.

16. A waveform generating device comprising:

a memory storing waveform data of a tone waveform corresponding to a phrase performance containing a plurality of musical notes, said tone waveform including one or more non-loop waveform segments to be read out in a non-repeated fashion and loop waveform segments to be read out in a repeated fashion, said tone waveform including at least one said loop waveform segment for each individual one of the notes; and a processor connected at least to said memory, and adapted to read out, from said memory, the waveform data of each segment of said tone waveform in a predetermined sequence, during which time said processor reads out the waveform data of each of the non-loop waveform segments only once and reading out the waveform data of each of the loop waveform segments repeatedly, said processor being also adapted to control a time length of repeated readout of the loop waveform segment corresponding to a specific one of the notes, to thereby variably control a time length of the specific note in such a manner that a total time length of the phrase performance is variably controlled.

* * * * *